US009765457B2

(12) United States Patent
Tahara et al.

(10) Patent No.: US 9,765,457 B2
(45) Date of Patent: Sep. 19, 2017

(54) BRAIDER AND TUBE BODY

(71) Applicants: MURATA MACHINERY, LTD., Kyoto-shi, Kyoto (JP); GIFU UNIVERSITY, Gifu-shi, Gifu (JP)

(72) Inventors: Ryosuke Tahara, Kyoto (JP); Tadashi Uozumi, Gifu (JP); Akio Ohtani, Gifu (JP)

(73) Assignees: MURATA MACHINERY, LTD., Kyoto (JP); GIFU UNIVERSITY, Gifu (JP)

( * ) Notice: Subject to any disclaimer, the term of this patent is extended or adjusted under 35 U.S.C. 154(b) by 281 days.

(21) Appl. No.: 14/663,310

(22) Filed: Mar. 19, 2015

(65) Prior Publication Data

US 2015/0275408 A1 Oct. 1, 2015

(30) Foreign Application Priority Data

Mar. 20, 2014 (JP) ..... 2014-59248

(51) Int. Cl.

| | |
|---|---|
| ***D04C 1/06*** | (2006.01) |
| ***D04C 3/48*** | (2006.01) |
| ***D04C 3/18*** | (2006.01) |
| ***D04C 3/28*** | (2006.01) |

(52) U.S. Cl.

CPC ..... *D04C 1/06* (2013.01); *D04C 3/18* (2013.01); *D04C 3/28* (2013.01); *D04C 3/48* (2013.01)

(58) Field of Classification Search

CPC ... D04C 1/06; D04C 3/26; D04C 3/28; D04C 3/30; D04C 3/48

See application file for complete search history.

(56) References Cited

U.S. PATENT DOCUMENTS

| | | | | |
|---|---|---|---|---|
| 2,879,687 | A * | 3/1959 | Leimbach | D04C 1/06 87/11 |
| 5,099,744 | A * | 3/1992 | Hurst | D04C 3/42 87/45 |
| 5,287,790 | A * | 2/1994 | Akiyama | B29C 70/16 87/11 |
| 5,385,077 | A * | 1/1995 | Akiyama | B29C 70/16 87/50 |
| 8,261,648 | B1 * | 9/2012 | Marchand | D04C 3/42 87/34 |
| 8,534,176 | B2 * | 9/2013 | Giszter | D04C 3/42 87/55 |

(Continued)

FOREIGN PATENT DOCUMENTS

| | | |
|---|---|---|
| JP | 2001-040557 A | 2/2001 |
| JP | 2002-339211 A | 11/2002 |
| JP | 2002-348763 A | 12/2002 |

*Primary Examiner* — Shaun R Hurley
(74) *Attorney, Agent, or Firm* — DLA Piper LLP (US)

(57) ABSTRACT

A braider and a tube body in which braids are arranged on an outer peripheral surface of a mandrel uniformly even if the diameter of the mandrel is uneven. A braider 1 has bobbin carrier conveyance mechanisms 50A and 50B in which bobbin carriers 40A and 40B are conveyed from traveling tracks W1 and W2 to an outside of the traveling tracks W1 and W2 so as to stop winding of braids Y1 and Y2 onto a mandrel 2 and the bobbin carriers 40A and 40B are conveyed from the outside of the traveling tracks W1 and W2 to the traveling tracks W1 and W2 so as to start the winding of the braids Y1 and Y2 onto the mandrel 2.

6 Claims, 34 Drawing Sheets

(56) References Cited

U.S. PATENT DOCUMENTS

| | | | | |
|---|---|---|---|---|
| 2009/0188380 | A1* | 7/2009 | Dow | H04N 21/23424 87/11 |
| 2011/0203446 | A1* | 8/2011 | Dow | D04C 1/06 87/11 |
| 2013/0167710 | A1* | 7/2013 | Dow | D04C 1/06 87/9 |

* cited by examiner

BRAIDER AND TUBE BODY

TECHNICAL FIELD

The present invention relates to a braider and a tube body.

BACKGROUND ART

Conventionally, an art of a braider in which braids are wound onto an outer peripheral surface of a mandrel is known (for example, see the Patent Document 1).

In the braider described in the Patent Document 1, separately from a traveling track composing a braid, a traveling track for a bobbin carrier which is used for supplying the bobbin carrier to the traveling track and separating the bobbin carrier from the traveling track (supply line and separation line) is provided. When the bobbin carrier is supplied to the traveling track and separated from the traveling track, the bobbin carrier travels along the supply line and the separation line.

However, it is necessary to provide the traveling track for the bobbin carrier for supplying the bobbin carrier to the traveling track and separating the bobbin carrier from the traveling track (supply line and separation line), whereby the apparatus may be enlarged.

In the conventional braider, a number of the braids wound onto the outer peripheral surface of the mandrel is constant.

In the conventional braider, when a diameter of the mandrel is constant, the braids can be arranged on the outer peripheral surface of the mandrel uniformly.

However, when the diameter of the mandrel is uneven, it may be difficult to arrange the braids on the outer peripheral surface of the mandrel uniformly.

When the diameter of the mandrel is uneven and the number of the braids wound onto the outer peripheral surface of the mandrel is set corresponding to a part of the mandrel at which the diameter is small, at the part of the mandrel at which the diameter is small, the braids are arranged on the outer peripheral surface of the mandrel closely. However, at the part of the mandrel at which the diameter is large, spaces may be generated between the braids and the braids may be arranged mesh-like.

When the number of the braids wound onto the outer peripheral surface of the mandrel is set corresponding to the part of the mandrel at which the diameter is large, at the part of the mandrel at which the diameter is large, the braids are arranged on the outer peripheral surface of the mandrel closely. However, at the part of the mandrel at which the diameter is small, a tube body composed from the braids may be loose with respect to the mandrel and a space may be generated between the tube body and the mandrel.

PRIOR ART REFERENCE

Patent Document

Patent Document 1: the Japanese Patent Laid Open Gazette 2001-40557

DISCLOSURE OF INVENTION

Problems to Be Solved by the Invention

The present invention provides a braider and a tube body in which braids can be arranged on an outer peripheral surface of a mandrel uniformly even if the diameter of the mandrel is uneven.

Means for Solving the Problems

According to the first invention, a braider wherein, while a mandrel is moved relatively to a support member in which a traveling track for a bobbin carrier is provided, the bobbin carrier travels along the traveling track so that braids spanned between the bobbin carrier and the mandrel are wound onto an outer peripheral surface of the mandrel, includes a bobbin carrier conveyance mechanism in which the bobbin carrier is conveyed from the traveling track to an outside of the traveling track so as to stop winding of the braids onto the mandrel and the bobbin carrier is conveyed from the outside of the traveling track onto the traveling track so as to start the winding of the braids onto the mandrel.

According to the second invention, the bobbin carrier conveyance mechanism supplies the bobbin carrier to the traveling track and separates the bobbin carrier from the traveling track at a same position in the traveling track.

According to the third invention, an impeller which makes the bobbin carrier on the traveling track travel along the traveling track is provided, and the bobbin carrier conveyance mechanism supplies the bobbin carrier to the traveling track and separates the bobbin carrier from the traveling track while the impeller is rotated along a braid winding direction.

According to the fourth invention, a missing part is formed in the traveling track, and the bobbin carrier conveyance mechanism includes a movable member in which an outer complementary track part and an inner complementary track part are formed and which can be moved between a supply position at which the outer complementary track part complements the missing part of the traveling track and the inner complementary track part is not included in the traveling track and a separation position at which the inner complementary track part complements the missing part of the traveling track and the outer complementary track part is not included in the traveling track, and an actuator which moves the movable member between the supply position and the separation position.

According to the fifth invention, a picking mechanism, which can engage the bobbin carrier with the traveling track and release the engagement of the bobbin carrier with the traveling track, is provided.

According to the sixth invention, a tube body is configured such that first braids and second braids, which are arranged spirally along an axial direction and slanted oppositely to each other with respect to the axis, are braided with each other so as to form a reinforcing fiber layer on an outer perimeter of a mandrel. A total number of the first braids and the second braids existing in a section perpendicular to an axis at a first position in the axial direction are different from a total number of the first braids and the second braids existing in a section perpendicular to the axis at a second position, which is different from the first position, in the axial direction.

EFFECT OF THE INVENTION

The present invention brings the following effects.

According to the first invention, by conveying the bobbin carrier to the outside of the traveling track with the bobbin carrier conveyance mechanism so as to stop the winding of the braids onto the mandrel, the number of the braids wound onto the mandrel can be reduced. By conveying the bobbin carrier from the outside of the traveling track onto the traveling track with the bobbin carrier conveyance mechanism so as to start the winding of the braids onto the mandrel, the number of the braids wound onto the mandrel can be increased. Accordingly, even if a diameter of the mandrel is uneven, the number of the braids wound onto the mandrel can be changed corresponding to the diameter of the mandrel so as to arrange the braids on the outer peripheral surface of the mandrel uniformly.

In the braider, by conveying the bobbin carrier with the bobbin carrier conveyance mechanism, the bobbin carrier is supplied to the traveling track and separated from the traveling track. Namely, in the braider, when the bobbin carrier is supplied to the traveling track and separated from the traveling track, the bobbin carrier does not travel. Accordingly, it is not necessary to provide any traveling track for the bobbin carrier which is used for supplying the bobbin carrier to the traveling track and separating the bobbin carrier from the traveling track. Then, the apparatus can be configured compactly.

By using the state that the winding of the braid onto the mandrel is stopped by conveying the bobbin carrier to the outside of the traveling track with the bobbin carrier conveyance mechanism, the bobbin with which the bobbin carrier is equipped can be exchanged. The bobbin exchange can be executed without providing any traveling track for the bobbin carrier which is used for supplying the bobbin carrier to the traveling track and separating the bobbin carrier from the traveling track, whereby the apparatus can be configured compactly.

According to the second invention, the bobbin carrier conveyance mechanism supplies the bobbin carrier to the traveling track and separates the bobbin carrier from the traveling track at the same position in the traveling track, whereby the apparatus can be configured compactly.

According to the third invention, the number of the braids wound onto the mandrel can be changed and the bobbin can be exchanged without stopping the winding of the braids onto the mandrel, whereby working efficiency can be improved.

According to the fourth invention, the bobbin carrier can be supplied to the traveling track and separated from the traveling track by changing the position of the movable member between the supply position and the separation position.

According to the fifth invention, by engaging the bobbin carrier with the traveling track with the picking mechanism, the bobbin carrier can be supplied to the traveling track. By releasing the engagement of the bobbin carrier with the traveling track with the picking mechanism, the bobbin carrier can be separated from the traveling track.

According to the sixth invention, even if a diameter of the mandrel is uneven, the braids can be arranged on the outer peripheral surface of the mandrel uniformly.

Figure 29:
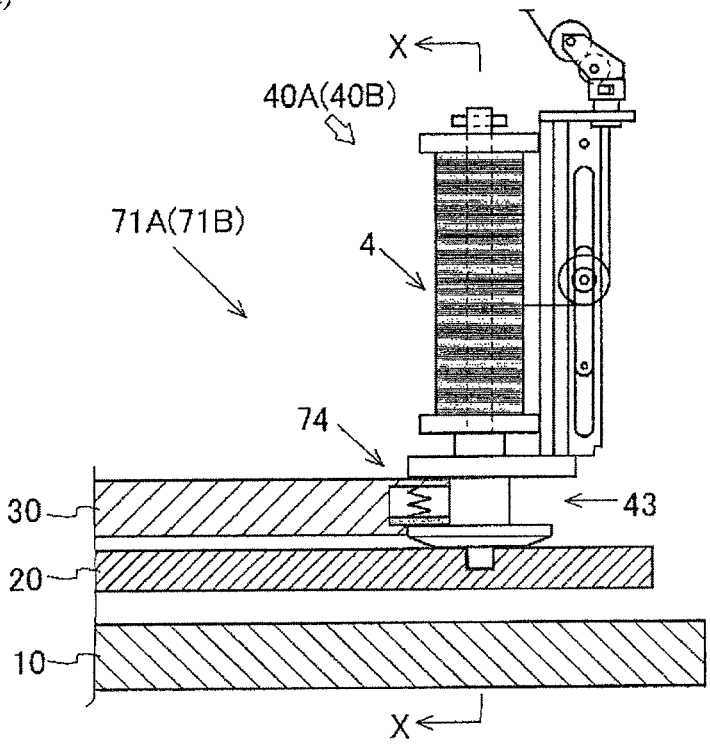
FIG. 29(*a*) is a partial sectional drawing of the state that the bobbin carrier travels along the traveling track, FIG. 29(*b*) is an arrow sectional view of the line X-X in FIG.
Figure 29:
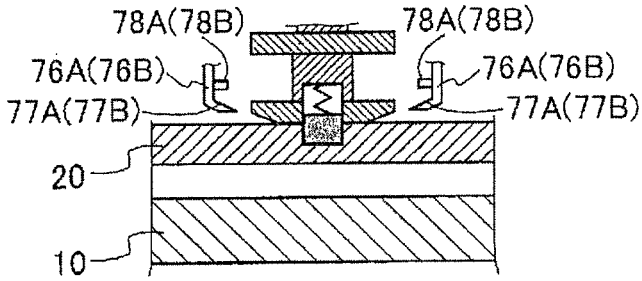
Figure 29:
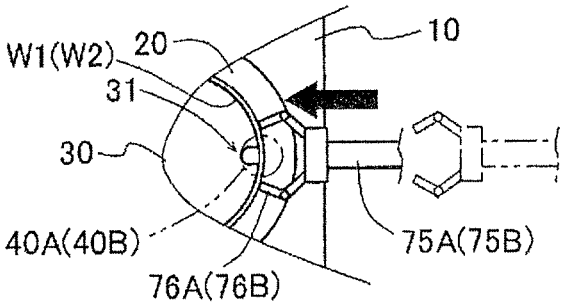

29(*a*), and FIG. 29(*c*) is a drawing of the robot hand when the bobbin carrier is at the state of FIG. 29(*a*).

Figure 30:
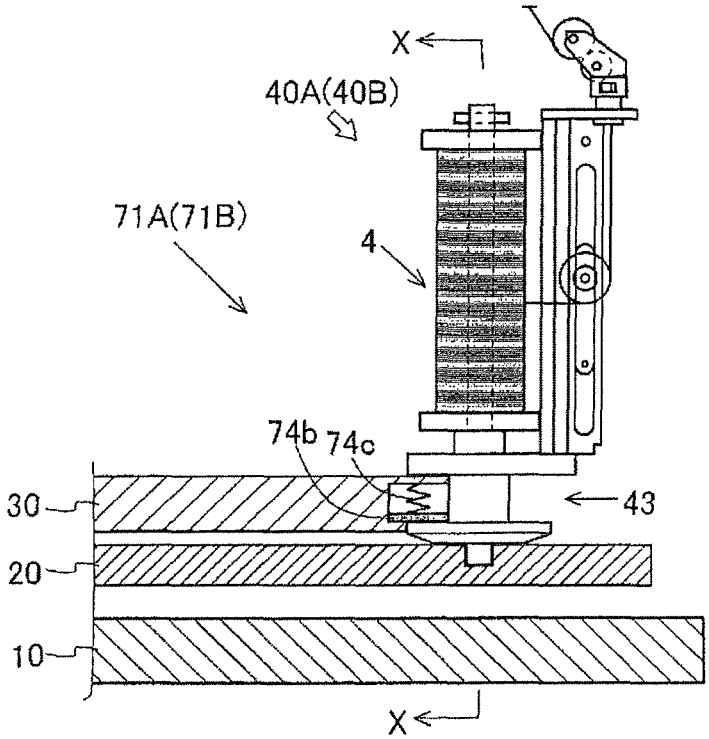
Figure 30:
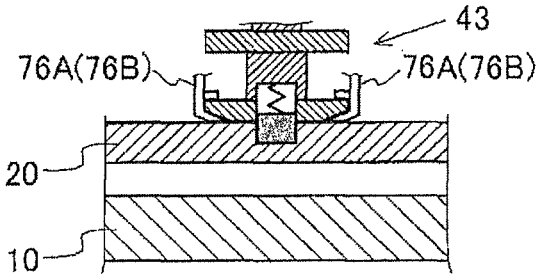
Figure 30:
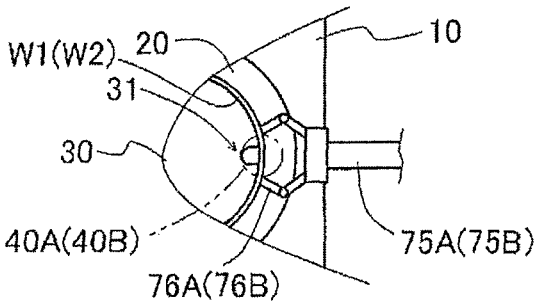

FIG. 30(*a*) is a partial sectional drawing of the state that the bobbin carrier travels along the traveling track, FIG. 30(*b*) is an arrow sectional view of the line X-X in FIG. 30(*a*), and FIG. 30(*c*) is a drawing of the robot hand when the bobbin carrier is at the state of FIG. 30(*a*).

Figure 31:
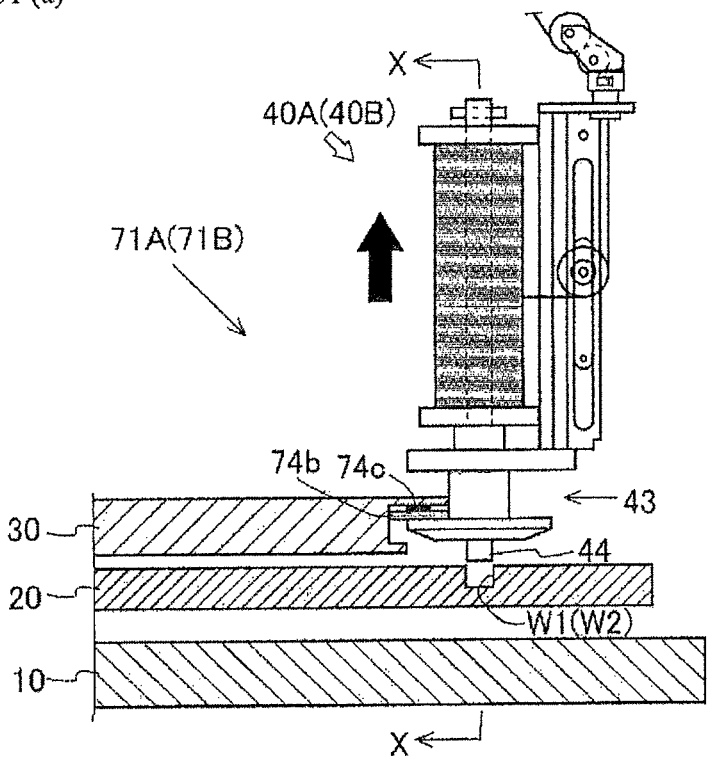
Figure 31:
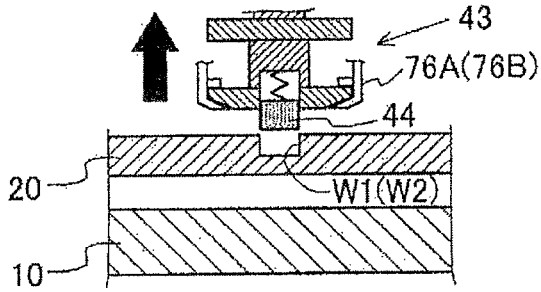
Figure 31:
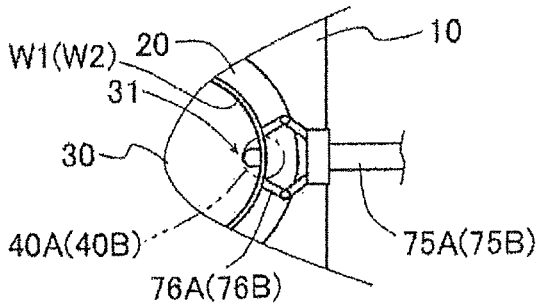

FIG. 31(*a*) is a partial sectional drawing of the state that engagement of the bobbin carrier with the traveling track is released, FIG. 31(*b*) is an arrow sectional view of the line X-X in FIG. 31(*a*), and FIG. 31(*c*) is a drawing of the robot hand when the bobbin carrier is at the state of FIG. 31(*a*).

Figure 32:
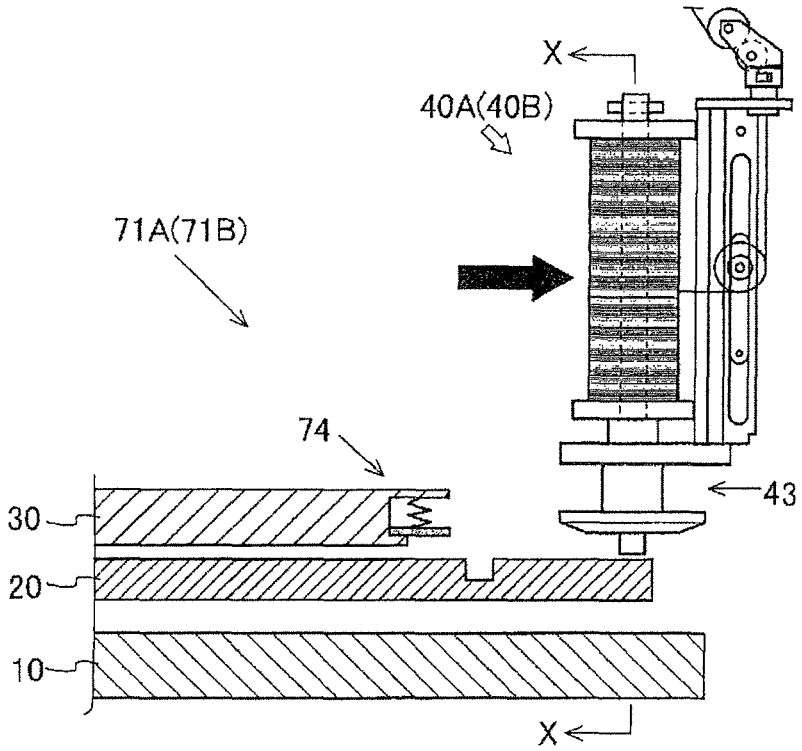
Figure 32:
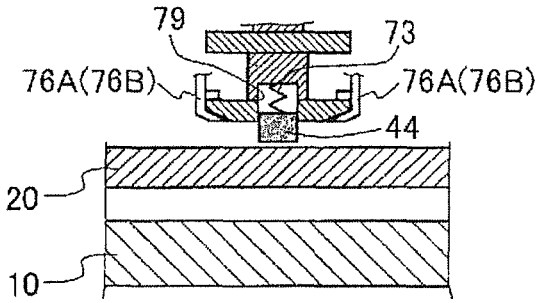
Figure 32:
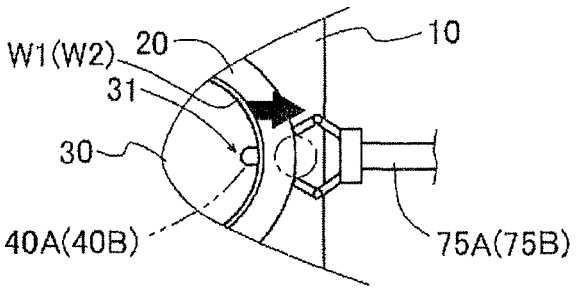

FIG. 32(*a*) is a partial sectional drawing of the state that the bobbin carrier is conveyed out of the traveling track, FIG. 32(*b*) is an arrow sectional view of the line X-X in FIG. 32(*a*), and FIG. 32(*c*) is a drawing of the robot hand when the bobbin carrier is at the state of FIG. 32(*a*).

Figure 33:
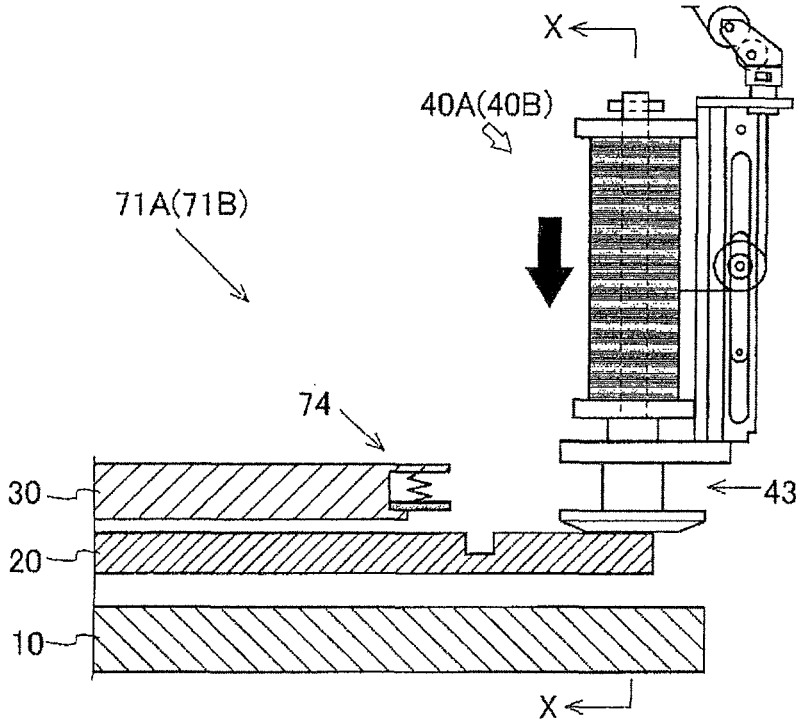
Figure 33:
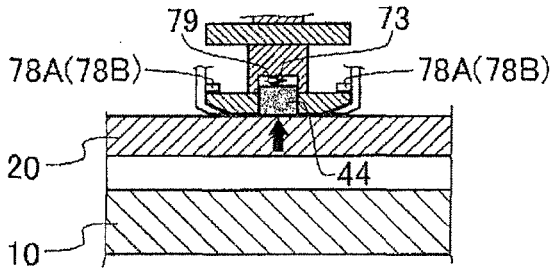
Figure 33:
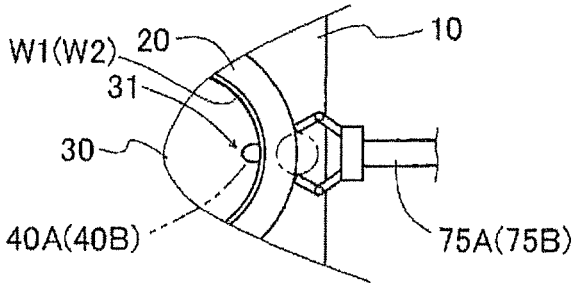

FIG. 33(*a*) is a partial sectional drawing of the state that a slider sinks into an engagement part, FIG. 33(*b*) is an arrow sectional view of the line X-X in FIG. 33(*a*), and FIG. 33(*c*) is a drawing of the robot hand when the bobbin carrier is at the state of FIG. 33(*a*).

Figure 34:
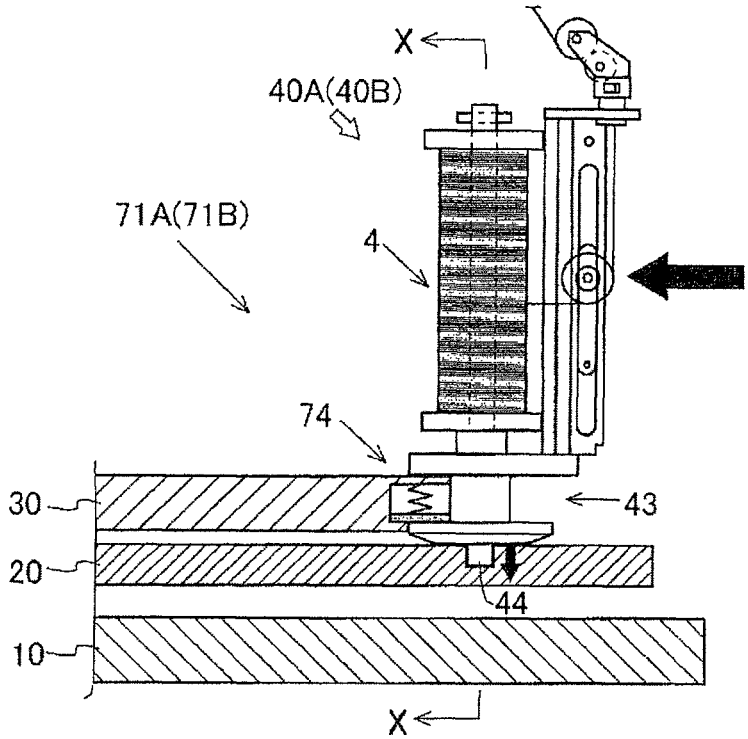
Figure 34:
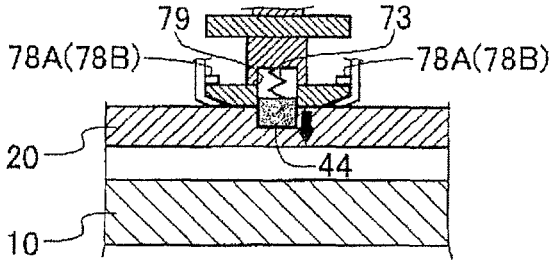
Figure 34:
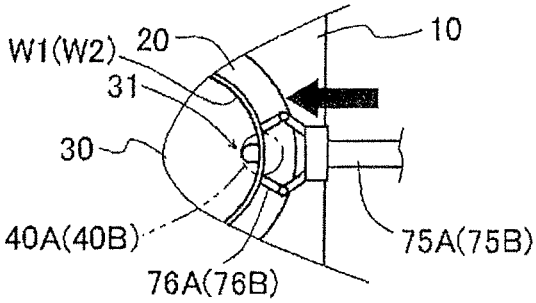

FIG. 34(*a*) is a partial sectional drawing of the state that the bobbin carrier is engaged with the traveling track, FIG. 34(*b*) is an arrow sectional view of the line X-X in FIG. 34(*a*), and FIG. 34(*c*) is a drawing of the robot hand when the bobbin carrier is at the state of FIG. 34(*a*).

DETAILED DESCRIPTION OF THE INVENTION

Figure 1:
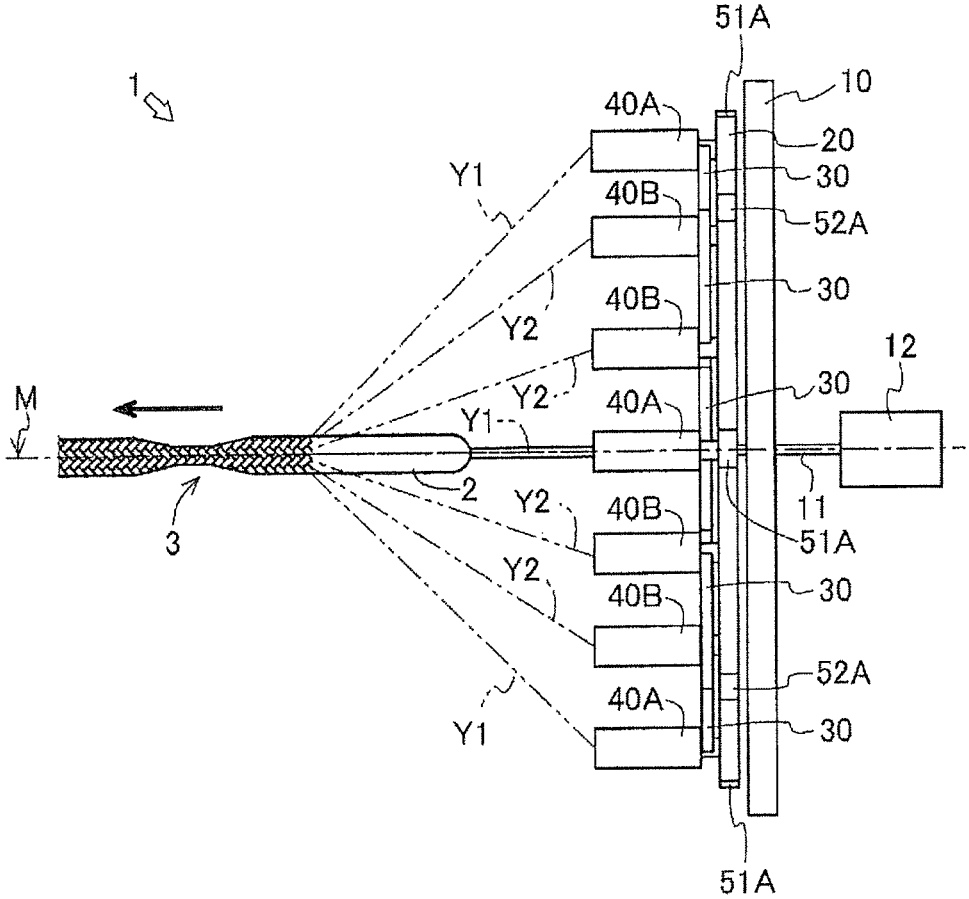
FIG. 1 is a drawing of a schematic configuration of a braider.
Figure 2:
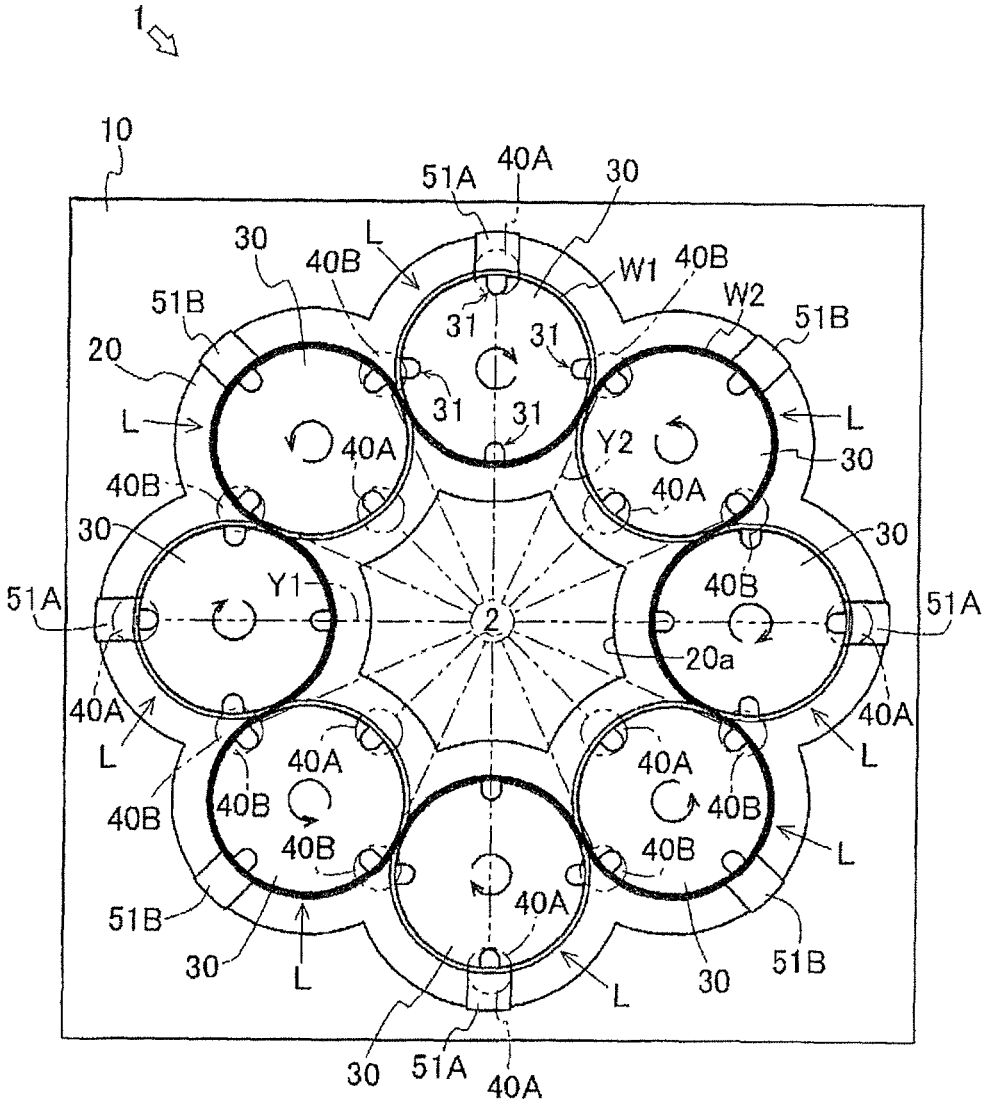
FIG. 2 is a front view of a frame.

As shown in FIGS. 1 and 2, a braider 1 winds braids Y1 and Y2 onto an outer peripheral surface of a mandrel 2 so as to manufacture a tube body 3 which is a tubular braided article constituted with the braids Y1 and Y2 on the outer peripheral surface of the mandrel 2.

The braider 1 has a frame 10, a support member 20 and a bobbin carrier conveyance mechanism.

The support member 20 is fixed to the frame 10. The support member 20 is formed plate-like and has a hole 20*a* at a center of the support member 20. The mandrel 2 is arranged oppositely to the hole 20*a* of the support member 20. A traveling device 12 is connected via a support shaft 11 to the mandrel 2. The traveling device 12 moves the mandrel 2 along a direction of an axis M. Though this embodiment is configured that the mandrel 2 is moved along the direction of the axis M, the present invention is not limited thereto and the support member 20 may alternatively be moved along the direction of the axis M.

The direction of the axis M is a direction of extension of the axis M of the mandrel 2. The axis M of the mandrel 2 is in agreement with an axis of the tube body 3.

Traveling tracks W1 and W2 are provided in a plate surface of the support member 20. The traveling tracks W1 and W2 are grooves respectively constituting traveling routes of bobbin carriers 40A and 40B. The traveling tracks W1 and W2 are shaped circularly so as to surround the hole 20*a* of the support member 20.

The pair of the traveling tracks W1 and W2 intersects each other periodically, and intersecting parts are arranged around the axis M of the mandrel 2. An entire form of the traveling tracks W1 and W2 intersecting each other is made by connecting a plurality of circles L, which are arranged around the axis M and adjacently to each other, to each other. In this embodiment, the eight circles L are provided around the axis M at intervals of 22.5°.

As shown in FIG. 2, an impeller 30 is arranged in an inner side of each of the circles L. The plurality of the impellers 30 are aligned circularly around the axis M. In this embodiment, the eight impellers 30 are arranged. The impeller 30 is supported rotatably along a peripheral direction of the circle L.

A plurality of notched parts 31 which can be engaged with the bobbin carriers 40A and 40B are formed in an edge of the impeller 30. In this embodiment, the four notched parts 31 are provided along a perimeter of the circle L at intervals of 90°.

A gear (not shown) is connected to each of the impellers 30, and the gears of the adjacent impellers 30 are meshed with each other. A driving device (motor) is connected to one of the gears. By driving the driving device, all the gears are rotated, and consequently, all the impellers 30 are rotated synchronously. The adjacent impellers 30 are rotated oppositely to each other (see FIG. 2).

Figure 3:
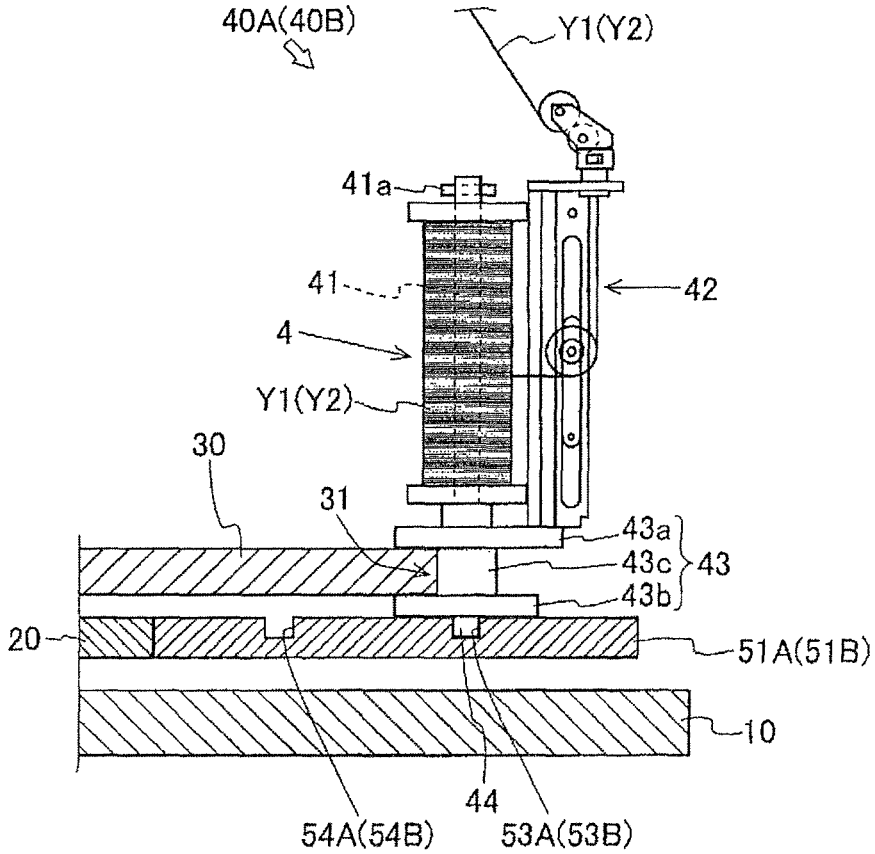
FIG. 3 is a side view of a bobbin carrier.

As shown in FIG. 3, each of the bobbin carriers 40A and 40B has a shaft 41, a guide roller part 42, an engagement part 43 and a slider part 44.

The shaft 41 has a bar-like shape which can penetrate the bobbin 4 and supports the bobbin 4 rotatably. A tip of the shaft 41 is equipped with a retaining pin 41*a* which prevents the bobbin 4 from falling down from the shaft 41. The one guide roller part 42 is provided around the shaft 41, and pulls out and guides the braid Y1 (Y2) which is wound onto the bobbin 4. The engagement part 43 has two flange parts 43*a* and 43*b* and a shaft part 43*c* interposed between the flange parts 43*a* and 43*b*. Each of the bobbin carriers 40A and 40B is engaged with the notched part 31 of the impeller 30 by pinching the notched part 31 with the flange parts 43*a* and 43*b*. The slider part 44 has a shape which can be inserted into the traveling track W1 (W2). The slider part 44 has an elliptic shape whose lengthwise direction is in agreement with a traveling direction. Accordingly, the bobbin carrier 40A (40B) can be transferred from the traveling track W1 (W2) to the traveling track W1 (W2) of the adjacent circle L at the intersecting part of the traveling track W1 (W2) (see FIG. 2).

As shown in FIGS. 2 and 3, the bobbin carrier 40A (40B) is engaged with the notched part 31 of the impeller 30, and the impeller 30 is rotated with the slider part 44 being inserted into the traveling track W1 (W2), so that the bobbin carrier 40A (40B) travels along the traveling track W1 (W2).

In the braider 1, by rotating all the impellers 30 so as to make the bobbin carrier 40A (40B) travel along the traveling track WI (W2) while the mandrel 2 is moved along the axis M relatively to the support member 20, the braid Y1 (Y2) spanned between the bobbin carrier 40A (40B) and the mandrel 2 is wound onto the outer peripheral surface of the mandrel 2. As a result, the tube body 3 is manufactured on the outer peripheral surface of the mandrel 2 (see FIG. 1).

In this embodiment, a track surface including the whole traveling tracks W1 and W2 on which the bobbin carriers 40A and 40B travel is formed by a flat surface, and the track surface is perpendicular to the axis M.

The track surface may not be the flat surface and may alternatively be a curved surface which is a part of a sphere surface centering on a point on the axis M. The point is a central position of braiding, and in this case, it is advantageous that, even if the bobbin carriers 40A and 40B travel along the traveling tracks W1 and W2, a distance between each of the bobbin carriers 40A and 40B and the central position of the braiding is not changed, whereby tension of the braid is hardly changed.

An explanation will be given on bobbin carrier conveyance mechanisms 50A and 50B which is a first embodiment of the bobbin carrier conveyance mechanism.

Figure 4:
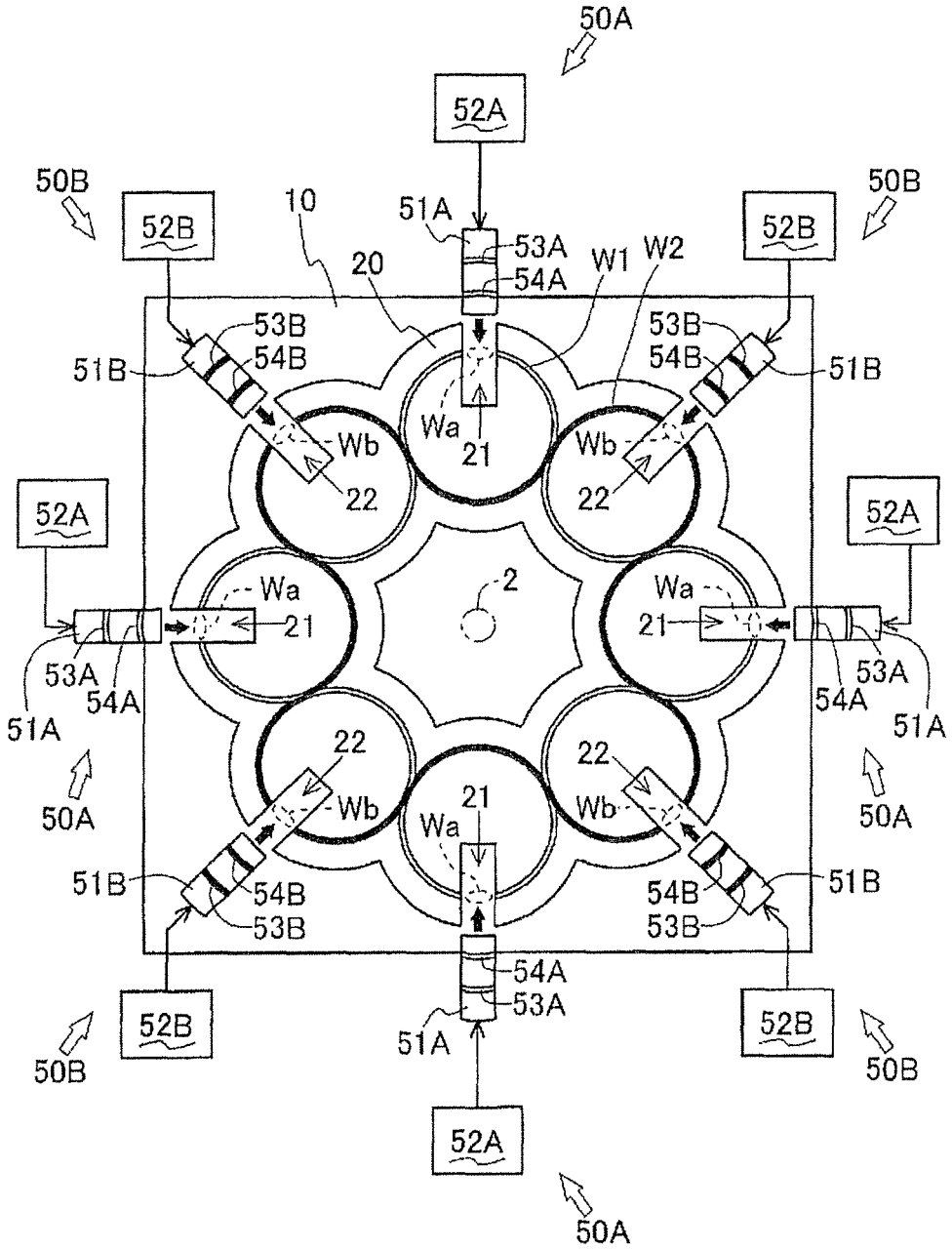
FIG. 4 is a drawing of a schematic configuration of a bobbin carrier conveyance mechanism of a first embodiment.

As shown in FIG. 4, in the support member 20, a notched part 21 dividing the first traveling track W1 and a notched part 22 dividing the second traveling track W2 are formed.

A missing part Wa is formed in the first traveling track W1 by the notched part 21, and a missing part Wb is formed in the second traveling track W2 by the notched part 22. The number of each of the missing parts Wa and Wb is at least one.

In this embodiment, the plurality of the notched parts 21 and 22 (the respective four notched parts 21 and 22) are formed, and consequently, the plurality of the missing parts Wa and Wb (the respective four missing parts Wa and Wb) are formed. The missing parts Wa and Wb are arranged mutually at intervals of 22.5° around the axis M.

The number of each of the bobbin carrier conveyance mechanisms 50A and 50B is at least one. The bobbin carrier conveyance mechanism 50A (50B) is provided for every notched part 21 (22). Therefore, in this embodiment, the number of each of the bobbin carrier conveyance mechanisms 50A and 50B is four.

The bobbin carrier conveyance mechanism 50A (50B) has a movable member 51A (51B) and an actuator 52A (52B).

The movable member 51A (51B) has a plate-like shape which can be engaged with the notched part 21 (22).

In the first movable member 51A, a first outer complementary track part 53A and a first inner complementary track part 54A are formed.

The first movable member 51A is supported so as to be movable between a first supply position and a first separation position.

Figure 5:
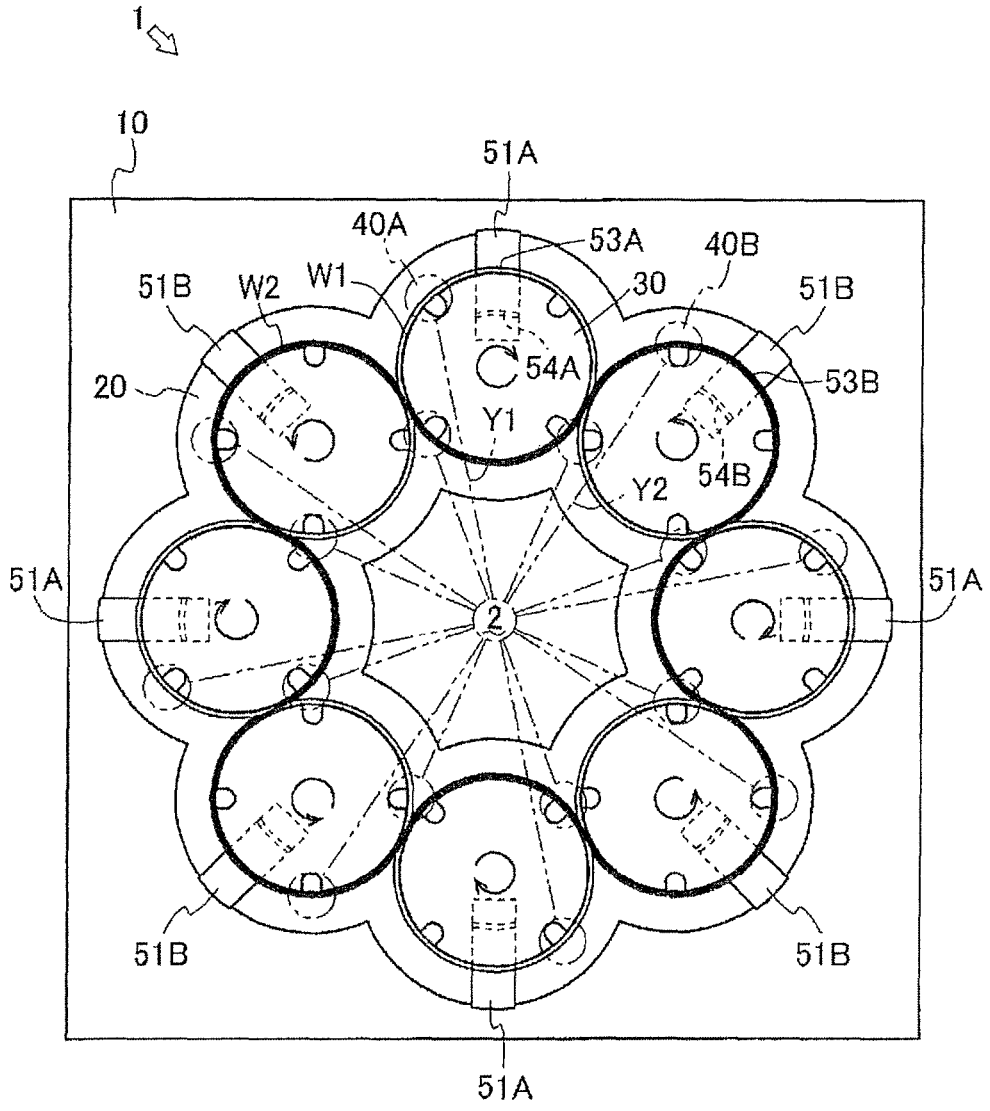
FIG. 5 is a drawing of the bobbin carrier at the time of winding a yarn.
Figure 6:
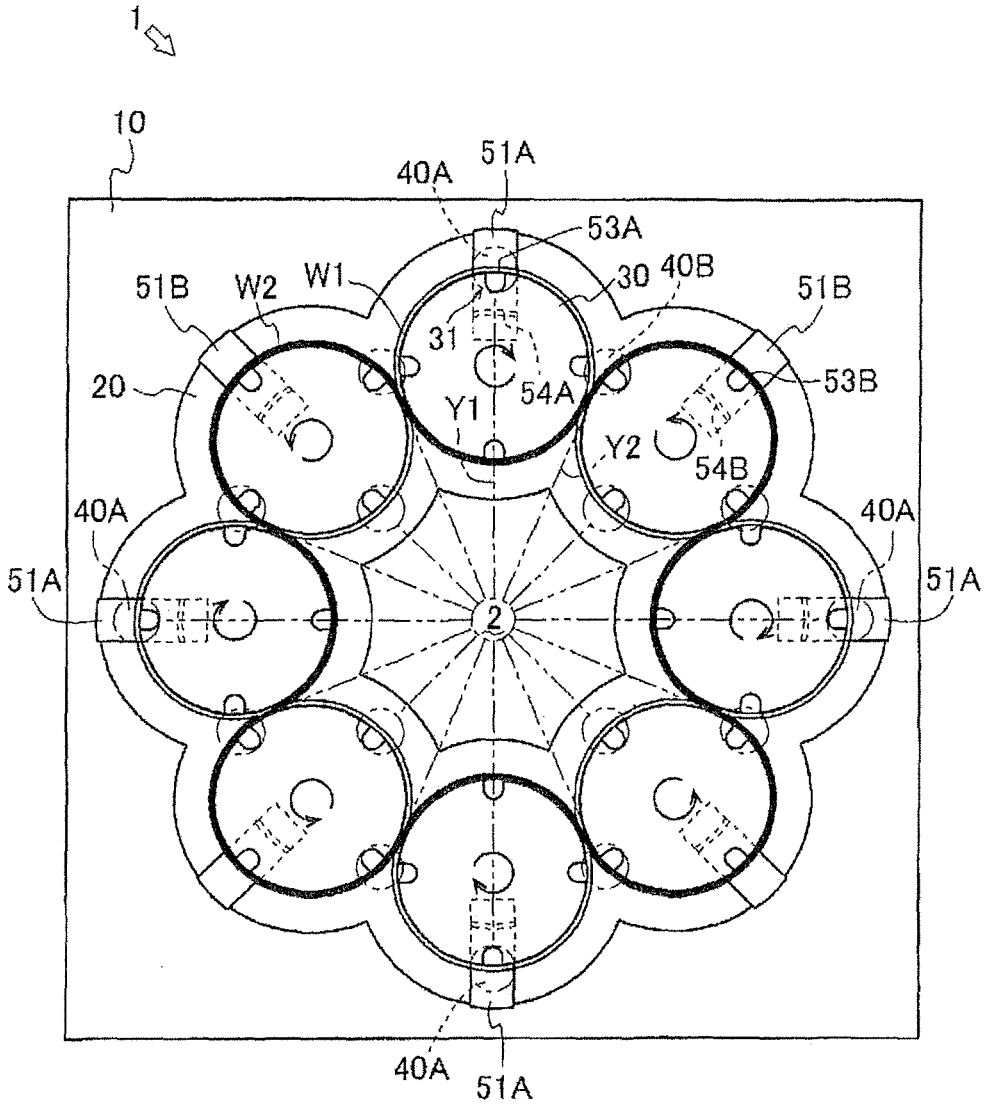
FIG. 6 is a drawing of the bobbin carrier at the time of winding the yarn.

At the first supply position, the first outer complementary track part 53A complements the missing part Wa of the first traveling track W1 and the first inner complementary track part 54A is not included in the first traveling track W1 (see FIGS. 4 and 5).

Figure 7:
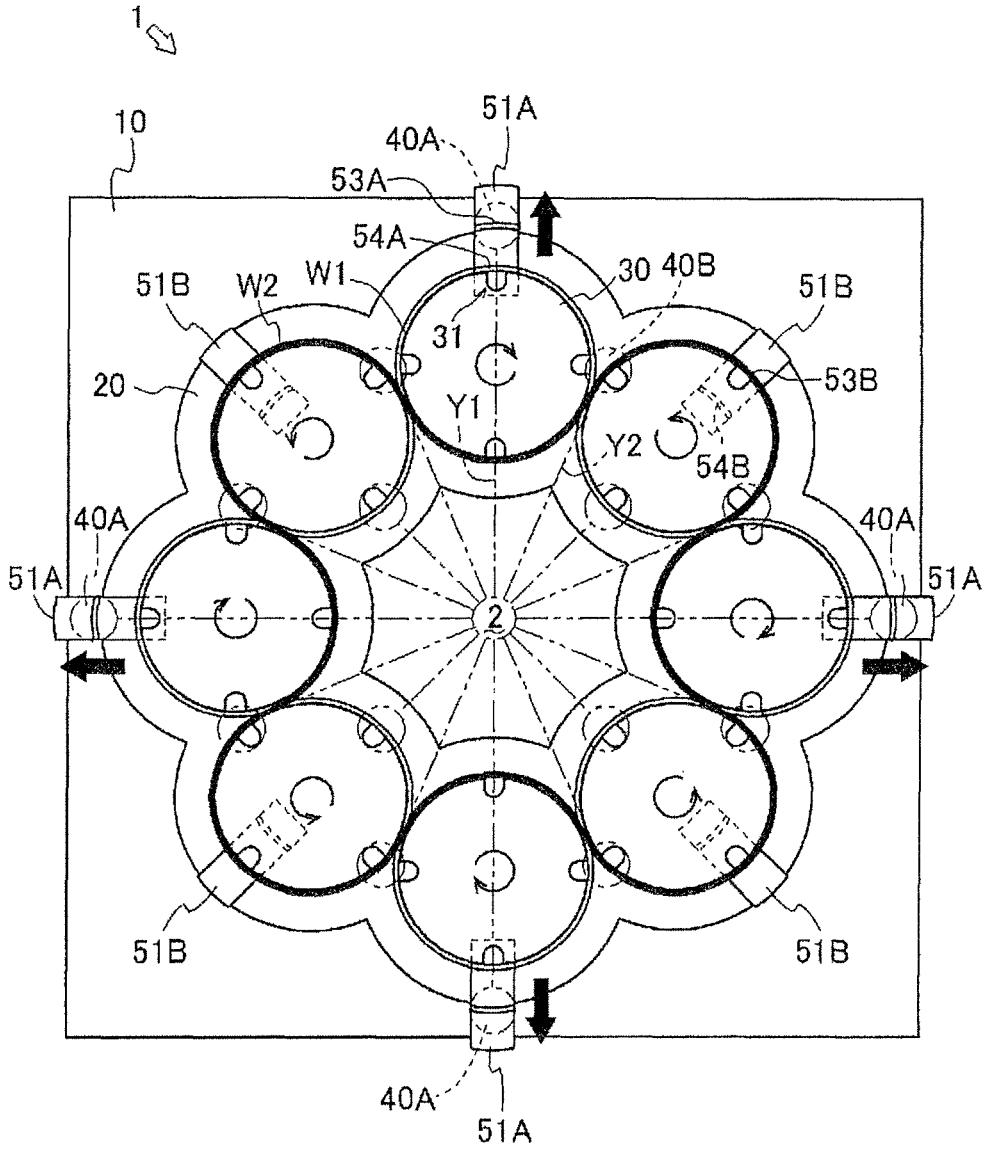
FIG. 7 is a drawing of the state that four first bobbin carriers are conveyed out of a traveling track by a first movable member.
Figure 8:
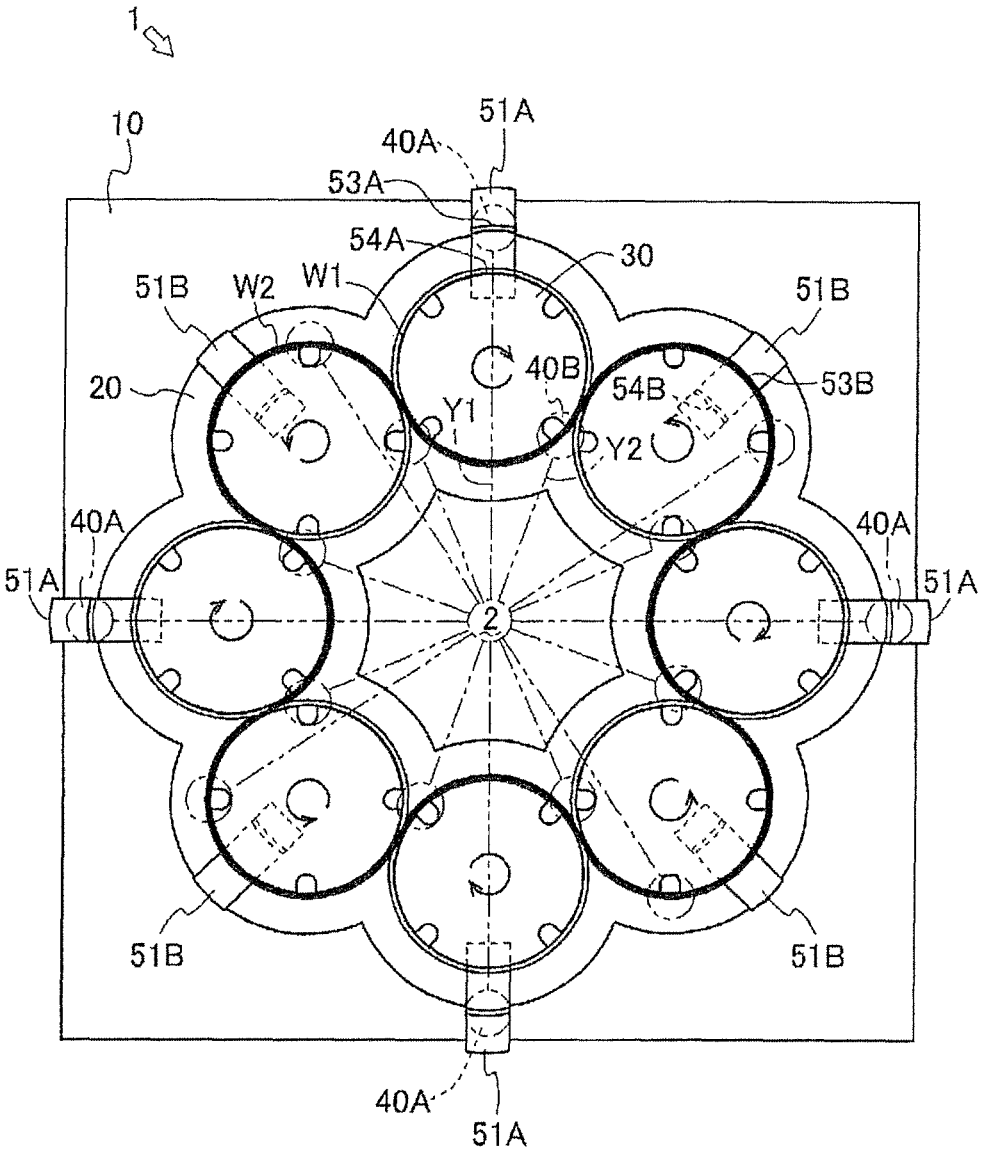
FIG. 8 is a drawing of the bobbin carrier at the time of winding the yarn.
Figure 9:
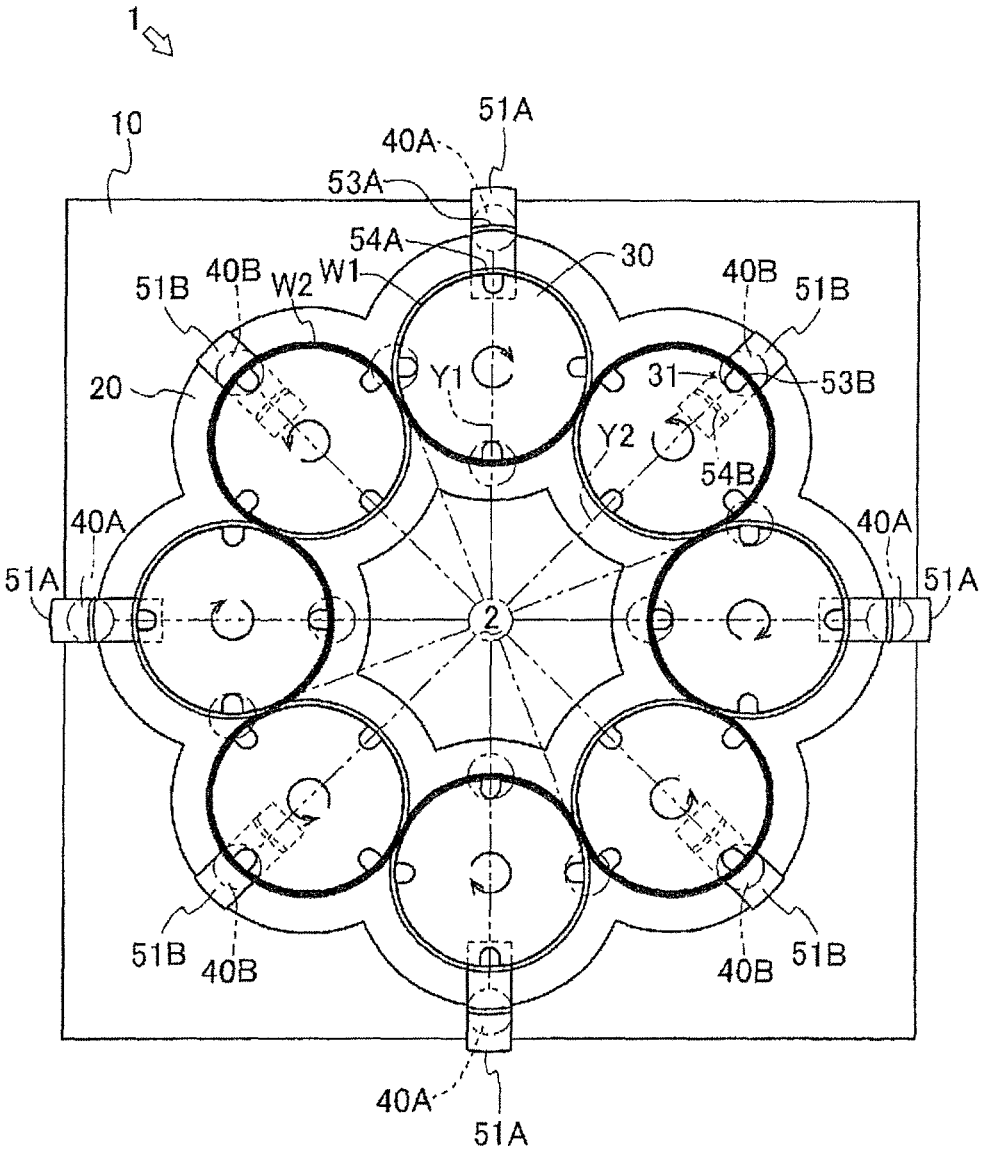
FIG. 9 is a drawing of the bobbin carrier at the time of winding the yarn.

At the first separation position, the first inner complementary track part 54A complements the missing part Wa of the first traveling track W1 and the first outer complementary track part 53A is not included in the first traveling track W1 (see FIGS. 4 and 7).

In the second movable member 51B, a second outer complementary track part 53B and a second inner complementary track part 54B are formed. The second movable member 51B is supported so as to be movable between a second supply position and a second separation position.

At the second supply position, the second outer complementary track part 53B complements the missing part Wb of the second traveling track W2 and the second inner complementary track part 54B is not included in the second traveling track W2 (see FIGS. 4 and 5).

Figure 10:
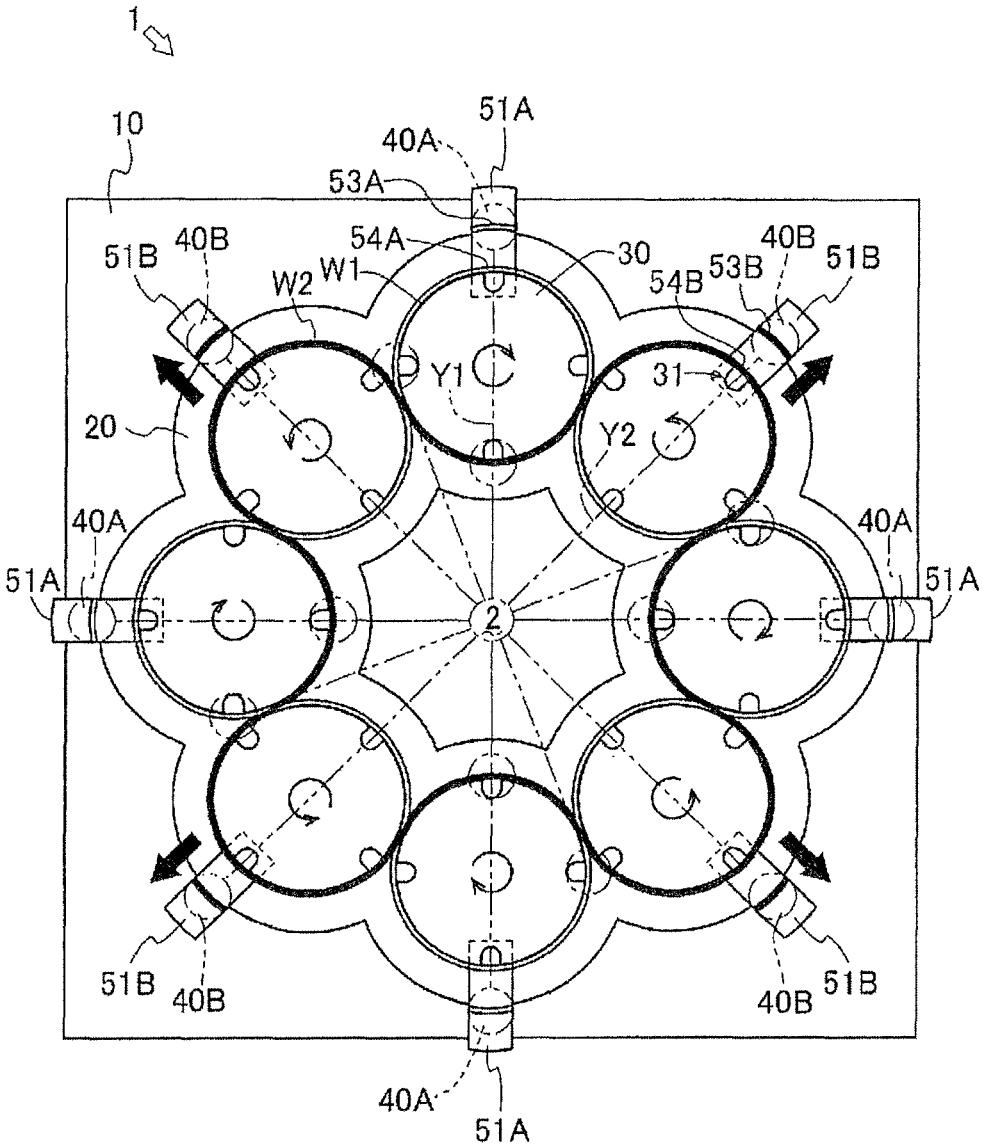
FIG. 10 is a drawing of the state that four second bobbin carriers are conveyed out of the traveling track by a second movable member.
Figure 11:
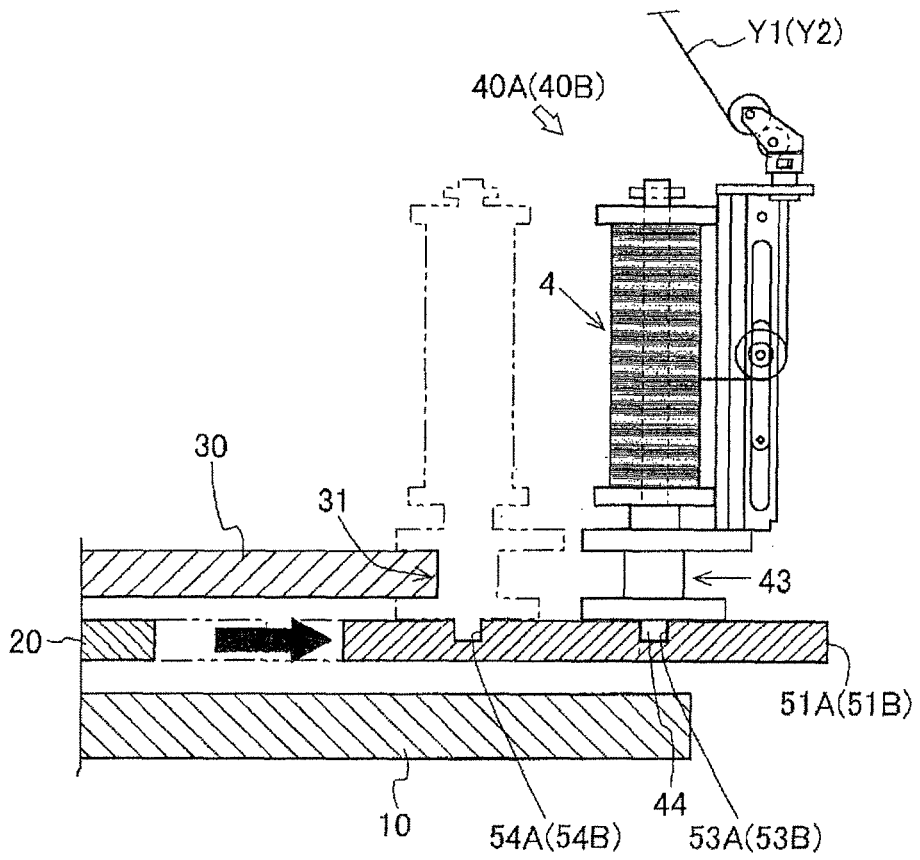
FIG. 11 is a drawing of the state that the bobbin carrier is conveyed out of the traveling track by a movable member.

At the second separation position, the second inner complementary track part 54B complements the missing part WB of the second traveling track W2 and the second outer complementary track part 53B is not included in the second traveling track W2 (see FIGS. 4 and 10).

The actuator 52A (52B) is connected to the movable member 51A (51B) (see FIG. 4). The movable member 51A (51B) can be moved between the first supply position (the second supply position) and the first separation position (the second separation position) with the actuator 52A (52B). For example, the actuator 52A (52B) includes a hydraulic cylinder or an air cylinder.

An explanation will be given on operation of the bobbin carrier conveyance mechanisms 50A and 50B.

FIGS. 5 to 10 and 13 to 18 show operation of the bobbin carriers 40A and 40B when the braids Y1 and Y2 are wound onto the outer peripheral surface of the mandrel 2 by the braider 1.

As shown in FIG. 5, in this embodiment, the eight first bobbin carriers 40A travel along the first traveling track W1, and the eight second bobbin carriers 40B travel along the second traveling track W2. Accordingly, the eight braids Y1 and the eight braids Y2 are wound onto the mandrel 2.

As shown in FIGS. 5 to 7, 11 and 12, when the first bobbin carrier 40A reaches the first outer complementary track part 53A of the first movable member 51A, the first movable member 51A is moved from the first supply position to the first separation position by the actuator 52A. Accordingly, engagement of the first bobbin carrier 40A on the first outer complementary track part 53A with the impeller 30 is canceled, and the first bobbin carrier 40A is conveyed to an outside of the first traveling track W1 and stopped. As a result, winding of the first braid Y1, which is spanned between the first bobbin carrier 40A conveyed to the outside of the first traveling track W1 and the mandrel 2, onto the mandrel 2 is stopped. At this time, the first braid Y1 whose winding onto the mandrel 2 is stopped is spanned between the first bobbin carrier 40A and the mandrel 2 at a position at which the first braid Y1 cannot contact the other braids Y1 and Y2 (see FIG. 12).

In this embodiment, the four first bobbin carriers 40A are conveyed to the outside of the first traveling track W1, whereby the four first braids Y1 are not wound onto the mandrel 2. The remaining four first bobbin carriers 40A continue traveling on the first traveling track W1, whereby the four first braids Y1 are wound onto the mandrel 2. The remaining four first bobbin carriers 40A, which continue traveling on the first traveling track W1, travel on the first inner complementary track part 54A at the missing part Wa.

As shown in FIGS. 8 to 11, when the second bobbin carrier 40B reaches the second outer complementary track part 53B of the second movable member 51B, the second movable member 51B is moved from the second supply position to the second separation position by the actuator 52B. Accordingly, engagement of the second bobbin carrier 40B on the second outer complementary track part 53B with the impeller 30 is canceled, and the second bobbin carrier 40B is conveyed to an outside of the second traveling track W2 and stopped. As a result, winding of the second braid Y2, which is spanned between the second bobbin carrier 40B conveyed to the outside of the second traveling track W2 and the mandrel 2, onto the mandrel 2 is stopped. At this time, the second braid Y2 whose winding onto the mandrel 2 is stopped is spanned between the second bobbin carrier 40B and the mandrel 2 at a position at which the second braid Y2 cannot contact the other braids Y1 and Y2 (see FIG. 12).

In this embodiment, the four second bobbin carriers 40B are conveyed to the outside the second traveling track W2, whereby the four second braids Y2 are not wound onto the mandrel 2. The remaining four second bobbin carriers 40B continue traveling on the second traveling track W2, whereby the four second braids Y2 are wound onto the mandrel 2. The remaining four second bobbin carriers 40B continuing traveling on the second traveling track W2 travel on the second inner complementary track part 54B at the missing part Wb.

As the above, all the first movable members 51A are moved from the first supply position to the first separation position and all the second movable members 51B are moved from the second supply position to the second separation position, whereby the total of the number of the braids Y1 and Y2 wound onto the mandrel 2 is eight (see FIG. 10).

As shown in FIGS. 13 to 15 and 19, when the notched part 31 of the impeller 30 reaches the first inner complementary track part 54A of the first movable member 51A, the first movable member 51A is moved from the first separation position to the first supply position by the actuator 52A. Accordingly, the first bobbin carrier 40A on the first outer complementary track part 53A is conveyed onto the first traveling track W1 and engaged with the notched part 31 of the impeller 30. As a result, the first bobbin carrier 40A conveyed onto the first traveling track WI starts traveling along the first traveling track W1, and the winding of the first braid Y1, which is spanned between the first bobbin carrier 40A and the mandrel 2, onto the mandrel 2 is started.

It may alternatively be configured that the first braid Y1 spanned between the first bobbin carrier 40A and the mandrel 2 is cut before the first bobbin carrier 40A on the first outer complementary track part 53A is supplied onto the first traveling track W1, and a yarn end of the cut first braid Y1 at the side of the first bobbin carrier 40A is conveyed to a winding position of the actual braids Y1 and Y2 on the mandrel 2 before the first bobbin carrier 40A is supplied onto the first traveling track W1. Accordingly, the yarn end of the first braid Y1, which is conveyed to the winding position of the actual braids Y1 and Y2 on the mandrel 2, is caught by the winding of the actual braids Y1 and Y2. As a result, when the first bobbin carrier 40A is supplied onto the first traveling track W1, the first braid Y1 of the first bobbin carrier 40A is wound at the winding position of the actual braids Y1 and Y2.

In this embodiment, the four first bobbin carriers 40A are conveyed onto the first traveling track W1. Accordingly, the total of the number of the first bobbin carriers 40A traveling on the first traveling track W1 is eight and the eight braids Y1 are wound onto the mandrel 2.

As shown in FIGS. 16 to 19, when the notched part 31 of the impeller 30 reaches the second inner complementary track part 54B of the second movable member 51B, the second movable member 51B is moved from the second separation position to the second supply position by the actuator 52B. Accordingly, the second bobbin carrier 40B on the second outer complementary track part 53B is conveyed onto the second traveling track W2 and engaged with the notched part 31 of the impeller 30. As a result, the second bobbin carrier 40B conveyed onto the second traveling track W2 starts traveling along the second traveling track W2, and the winding of the second braid Y2, which is spanned between the second bobbin carrier 40B and the mandrel 2, onto the mandrel 2 is started.

It may alternatively be configured that the second braid Y2 spanned between the second bobbin carrier 40B and the mandrel 2 is cut before the second bobbin carrier 40B on the second outer complementary track part 53B is supplied onto the second traveling track W2, and a yarn end of the cut second braid Y2 at the side of the second bobbin carrier 40B is conveyed to a winding position of the actual braids Y1 and Y2 on the mandrel 2 before the second bobbin carrier 40B is supplied onto the second traveling track W2. Accordingly, the yarn end of the second braid Y2, which is conveyed to the winding position of the actual braids Y1 and Y2 on the mandrel 2, is caught by the winding of the actual braids Y1 and Y2. As a result, when the second bobbin carrier 40B is supplied onto the second traveling track W2, the second braid Y2 of the second bobbin carrier 40B is wound at the winding position of the actual braids Y1 and Y2.

In this embodiment, the four second bobbin carriers 40B are conveyed onto the second traveling track W2. Accordingly, the total of the number of the second bobbin carriers 40B traveling on the second traveling track W2 is eight and the eight braids Y2 are wound onto the mandrel 2.

Figure 18:
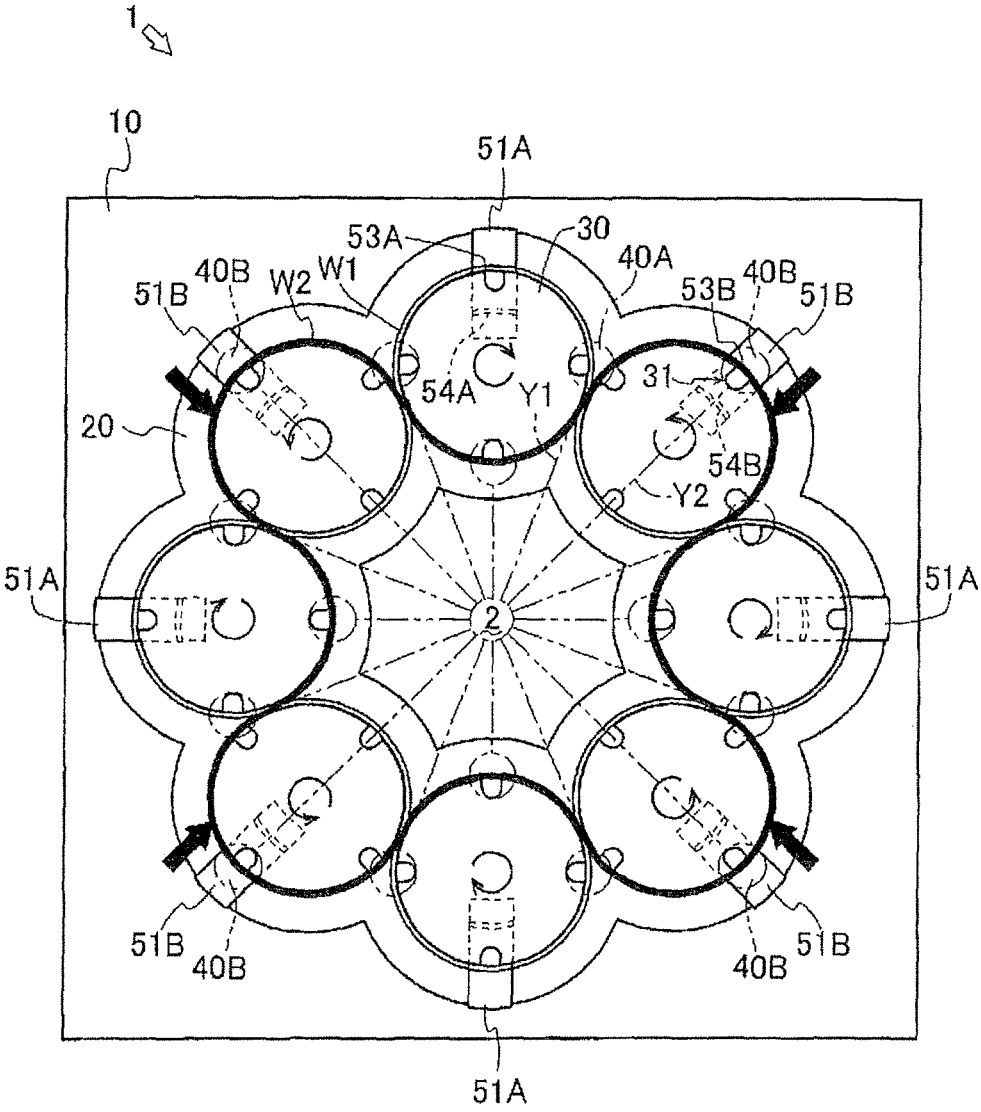
FIG. 18 is a drawing of the state that the four second bobbin carriers are conveyed onto the traveling track by the second movable member.
Figure 19:
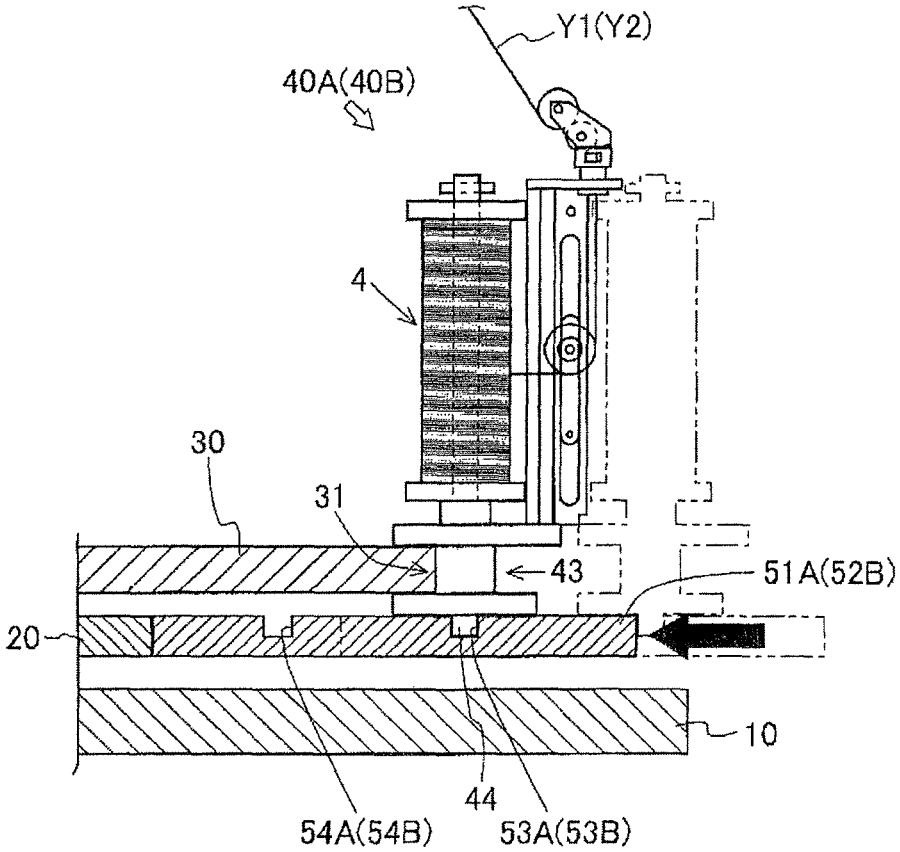
FIG. 19 is a drawing of the state that the bobbin carrier is conveyed onto the traveling track by the movable member.

In the above, all the first movable members 51A are moved from the first separation position to the first supply position and all the second movable members 51B are moved from the second separation position to the second supply position, whereby the total number of the braids Y1 and Y2 wound onto the mandrel 2 is sixteen (see FIG. 18).

Each of the actuators 52A and 52B may alternatively be operated by a control device. In this case, the control device detects positions of the bobbin carriers 40A and 40B with sensors such as a touch sensor, a proximity sensor and an image sensor and judges timing of operation of each of the actuators 52A and 52B.

Each of the actuators 52A and 52B may alternatively be operated by operation of a suitable operation instrument by an operator. In this case, the operator checks the positions of the bobbin carriers 40A and 40B with the naked eye and judges the timing of operation of each of the actuators 52A and 52B.

In the braider 1, by operating the movable members 51A and 51B with the actuators 52A and 52B, the number of the braids Y1 and Y2 wound onto the mandrel 2 can be changed corresponding to a diameter of the mandrel 2 even if the diameter of the mandrel 2 is uneven.

Figure 20:
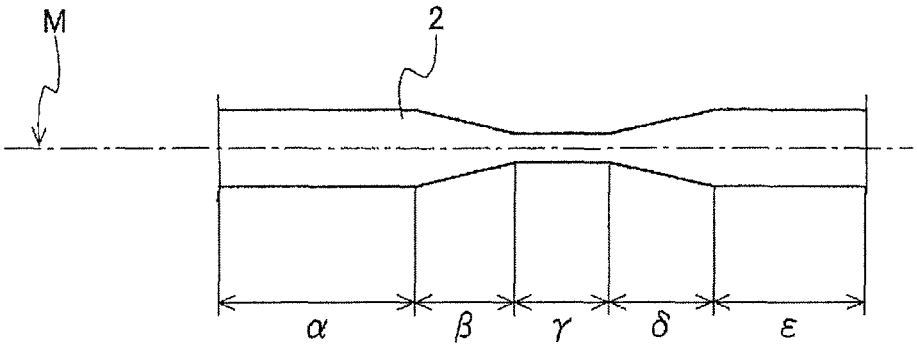
FIG. 20(*a*) is a side view of a mandrel, FIG. 20(*b*) is a side view of a tube body, FIG. 20(*c*) is a sectional view of the tube body at a first position perpendicular to its axis, and FIG. 20(*d*) is a sectional view of the tube body at a second position perpendicular to the axis.
Figure 20:
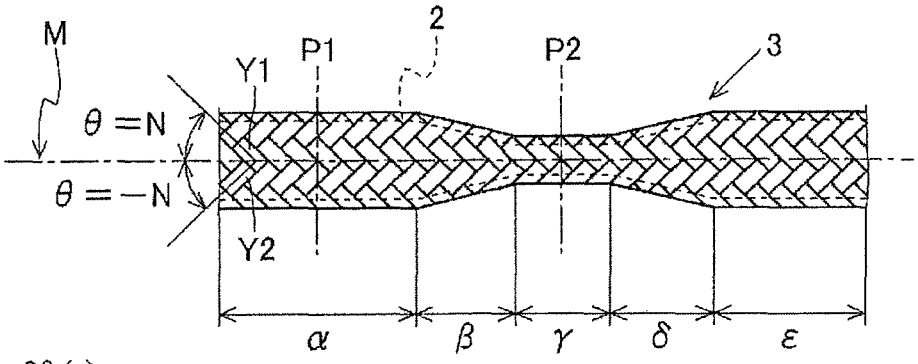
Figure 20:
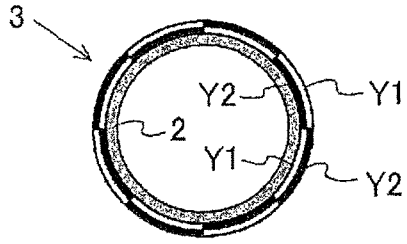
Figure 20:
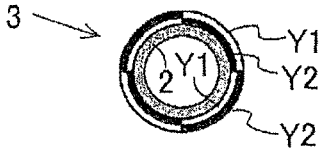

For example, as shown in FIG. 20(*a*) and FIG. 20(*b*), the braids Y1 and Y2 are wound onto areas α, β, γ, δ, ϵ of the mandrel 2 in this order. In the area α, the diameter of the mandrel 2 is large and fixed. In the area β, the diameter of the mandrel 2 is reduced following advance of winding of the braids Y1 and Y2. In the area γ, the diameter of the mandrel 2 is small (half of the area α) and fixed. In the area δ, the diameter of the mandrel 2 is increased following advance of the winding of the braids Y1 and Y2. In the area ϵ, the diameter of the mandrel 2 is large (equal to the area α) and fixed.

In the case of winding the braids Y1 and Y2 onto the mandrel 2, with respect to the area α, all the first movable members 51A are arranged at the first supply position and all the second movable members 51B are arranged at the second supply position, whereby the sixteen braids Y1 and Y2 are wound.

With respect to the area β, following advance of the winding position of the braids Y1 and Y2, the first movable members 51A at the first separation position and the second movable members 51B at the second separation position are increased gradually. Accordingly, the total number of the braids Y1 and Y2 wound onto the mandrel 2 is reduced gradually from sixteen.

With respect to the area y, all the first movable members 51A are arranged at the first separation position and the second movable members 51B are arranged at the second separation position, whereby the eight braids Y1 and Y2 are wound.

With respect to the area δ, following advance of the winding position of the braids Y1 and Y2, the first movable members 51A at the first supply position and the second movable members 51B at the second supply position are increased gradually. Accordingly, the total number of the braids Y1 and Y2 wound onto the mandrel 2 is increased gradually from eight.

With respect to the area ϵ, all the first movable members 51A are arranged at the first supply position and all the second movable members 51B are arranged at the second supply position, whereby the sixteen braids Y1 and Y2 are wound.

As the above, the movable members 51A and 51B are operated corresponding to the diameter of the mandrel 2 and the number of the braids Y1 and Y2 wound onto the mandrel 2 is changed so that the braids Y1 and Y2 can be arranged closely while contacting the outer peripheral surface of the mandrel 2 even if the diameter of the mandrel 2 is uneven, whereby the braids Y1 and Y2 can be arranged on the outer peripheral surface of the mandrel 2 uniformly (see FIGS. 20(*b*) to 20(*d*)).

In the braider 1, the braids Y1 and Y2 are wound onto the outer peripheral surface of the mandrel 2 so as to manufacture the tube body 3 which is a tubular braided article constituted with the braids Y1 and Y2 on the outer peripheral surface of the mandrel 2. The tube body 3 forms a reinforcing fiber layer on the outer perimeter of the mandrel 2.

As the braids Y1 and Y2 constituting the reinforcing fiber layer, there are a glass fiber, an aramid fiber, a carbon fiber and the like. A FRP (fiber reinforced plastic) layer may be configured by hardening the reinforcing fiber layer with resin.

As shown in FIG. 20(*b*), the tube body 3 is configured that the braids Y1 and Y2, which are arranged spirally along the axis M and slanted oppositely to each other with respect to the axis M, are braided with each other. Namely, the slant of the first braid Y1 is opposite to the slant of the second braid Y2, and a magnitude (absolute value) of a slant angle θ of the first braid Y1 is equal to that of the second braid Y2. In this embodiment, the first braid Y1 is slanted for N° with respect to the axis M and the second braid Y2 is slanted for −N° with respect to the axis M.

By changing a speed ratio of a traveling speed of each of the bobbin carriers 40A and 40B and a moving speed of the mandrel 2, the slant angle θ of the braids Y1 and Y2 the tube body 3 can be changed.

As shown in FIGS. 20(*b*) to 20(*d*), concerning the tube body 3, the total number of the braids Y1 and Y2 existing in a section perpendicular to the axis M at a first position P1 in an direction of the axis M is different from the total number of the braids Y1 and Y2 existing in a section perpendicular to the axis M at a second position P2 different from the first position P1 in the direction of the axis M.

In this embodiment, since the first position P1 exists in the area a, the sixteen braids Y1 and Y2 are wound onto the first position P1. Therefore, the sixteen braids Y1 and Y2 exist in the section perpendicular to the axis M at the first position P1 (see FIGS. 20(*b*) and 20(*c*)). Since the second position P2 exists in the area δ, the eight braids Y1 and Y2 are wound onto the second position P2. Therefore, the eight braids Y1 and Y2 exist in the section perpendicular to the axis M at the second position P2 (see FIGS. 20(*b*) and 20(*d*)).

Accordingly, in the tube body 3, the total number of the braids Y1 and Y2 existing in the section perpendicular to the axis M is uneven concerning the position in the direction of the axis M. Therefore, the braids Y1 and Y2 can be arranged closely while contacting the outer peripheral surface of the mandrel 2 even if the diameter of the mandrel 2 is uneven, whereby the braids Y1 and Y2 can be arranged on the outer peripheral surface of the mandrel 2 uniformly (see FIGS. 20(*b*) to 20(*d*)).

In the braider 1, the bobbin carrier 40A (40B) is conveyed out of the traveling track WI (W2) with the bobbin carrier conveyance mechanism 50A (50B) so that the winding of the braid Y1 (Y2) spanned between the bobbin carrier 40A (40B) and the mandrel 2 onto the mandrel 2 is stopped. By using this state, the bobbin 4 can be exchanged.

The exchange of the bobbin 4 is performed by below steps (1) to (5).

Figure 12:
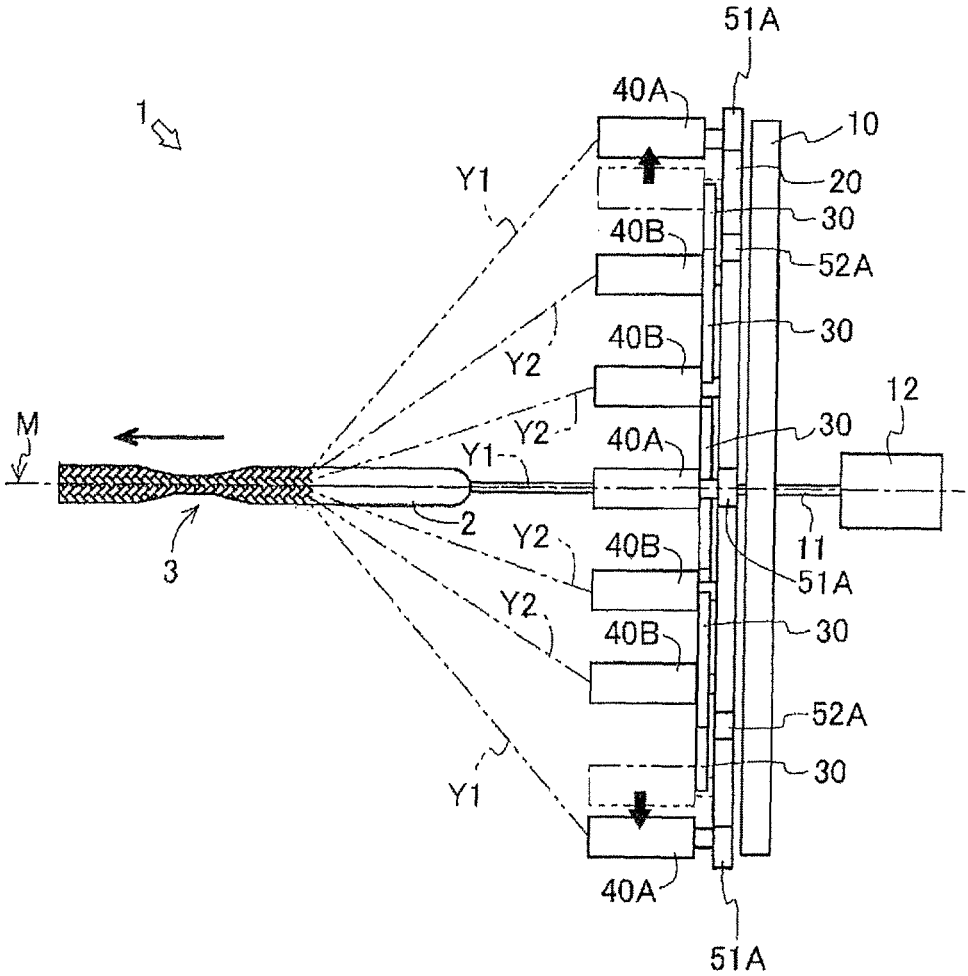
FIG. 12 is a drawing of the state that the four first bobbin carriers are conveyed out of the traveling track by the first movable member.
Figure 13:
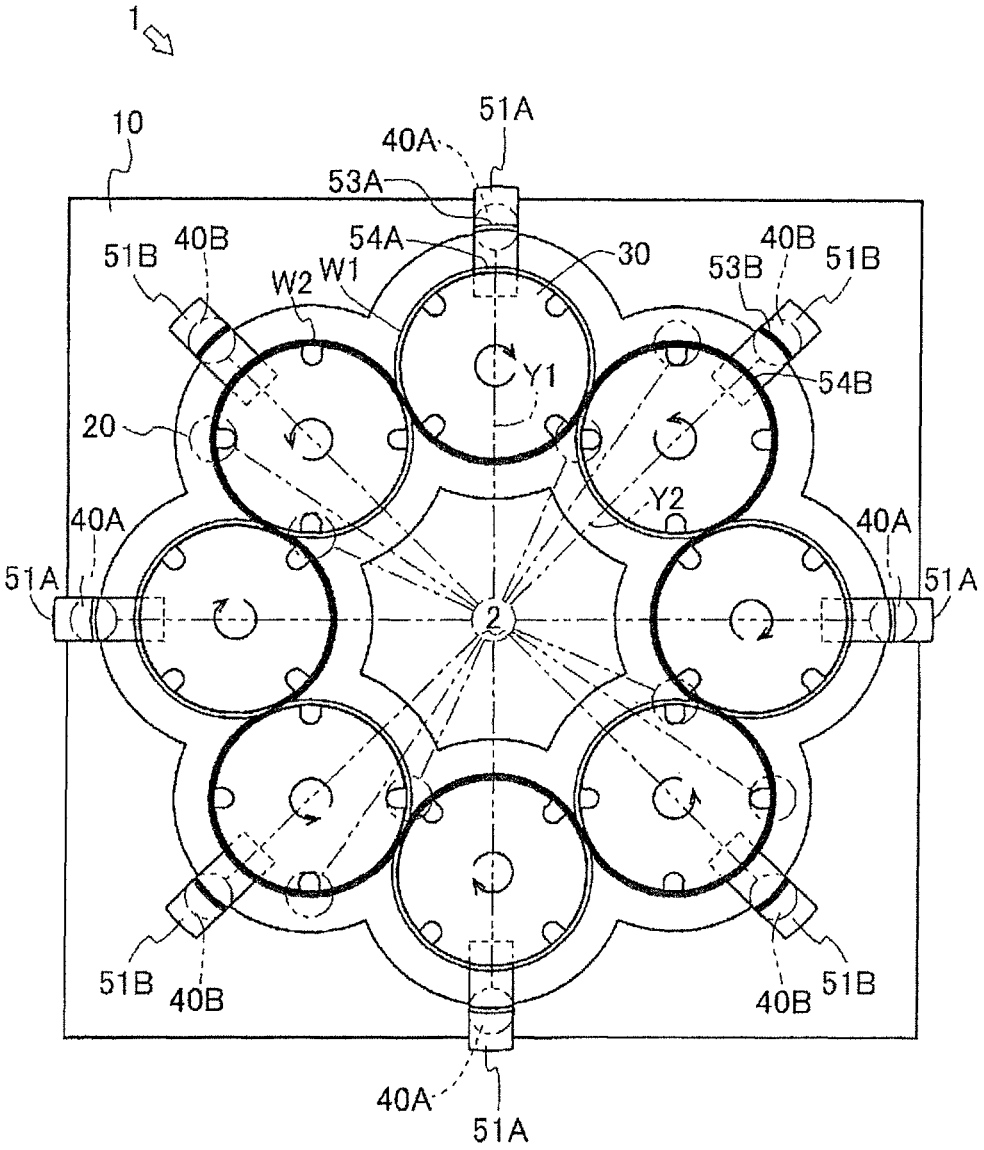
FIG. 13 is a drawing of the bobbin carrier at the time of winding the yarn.
Figure 14:
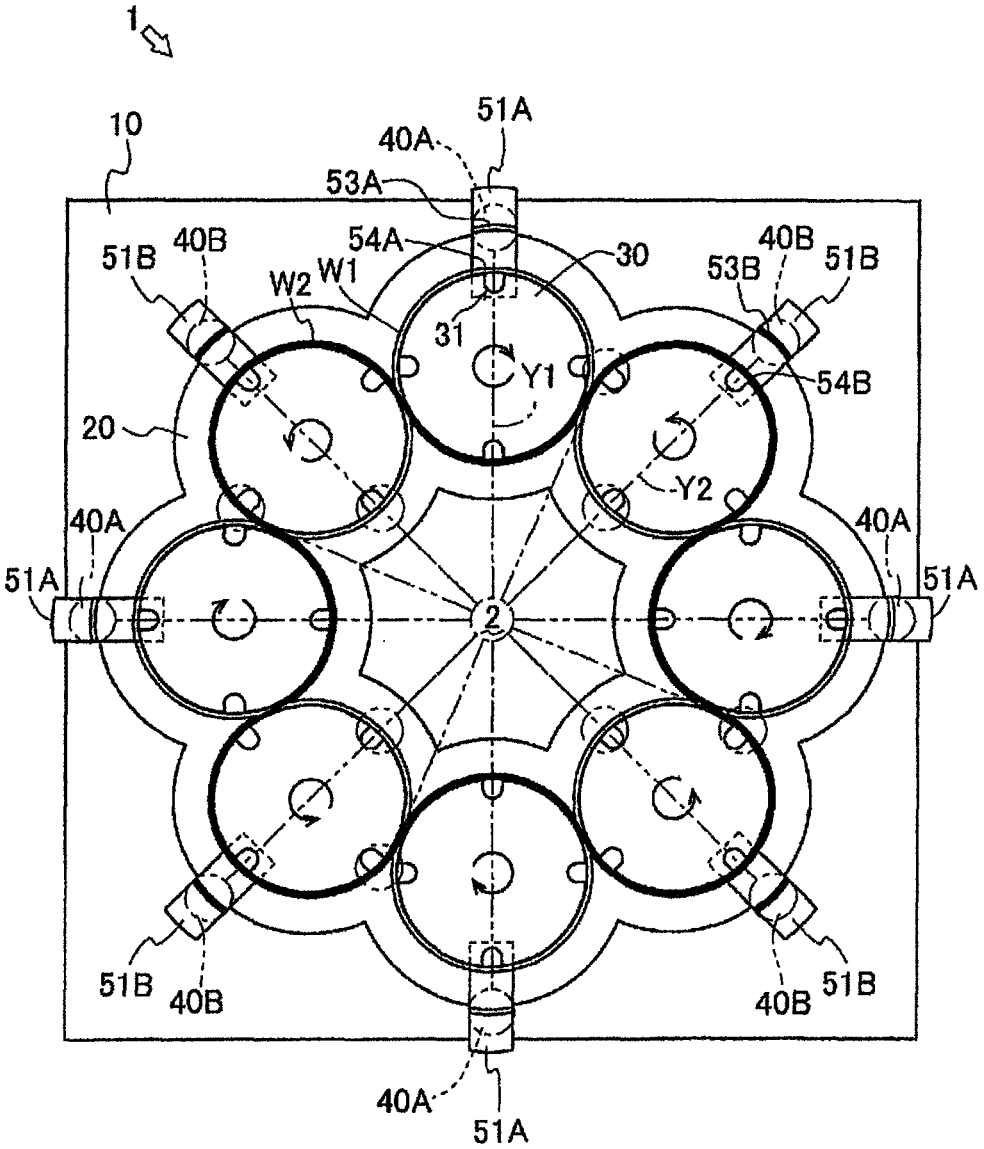
FIG. 14 is a drawing of the bobbin carrier at the time of winding the yarn.

(1) The bobbin carrier 40A (40B) is conveyed out of the traveling track WI (W2) with the bobbin carrier conveyance mechanism 50A (50B) so that the winding of the braid Y1 (Y2) spanned between the bobbin carrier 40A (40B) and the mandrel 2 onto the mandrel 2 is stopped (see FIGS. 7, 10 and 12).

(2) The braid Y1 (Y2) spanned between the bobbin carrier 40A (40B) and the mandrel 2 is cut.

(3) The bobbin 4 with which the bobbin carrier 40A (40B) is equipped is exchanged.

(4) The braid Y1 (Y2) is pulled out from the bobbin after exchanged (full bobbin), and the yarn end of the braid Y1 (Y2) which is pulled out is connected to the yarn end of the braid Y1 (Y2) at the side of the mandrel 2 which is cut in the step (2).

Figure 15:
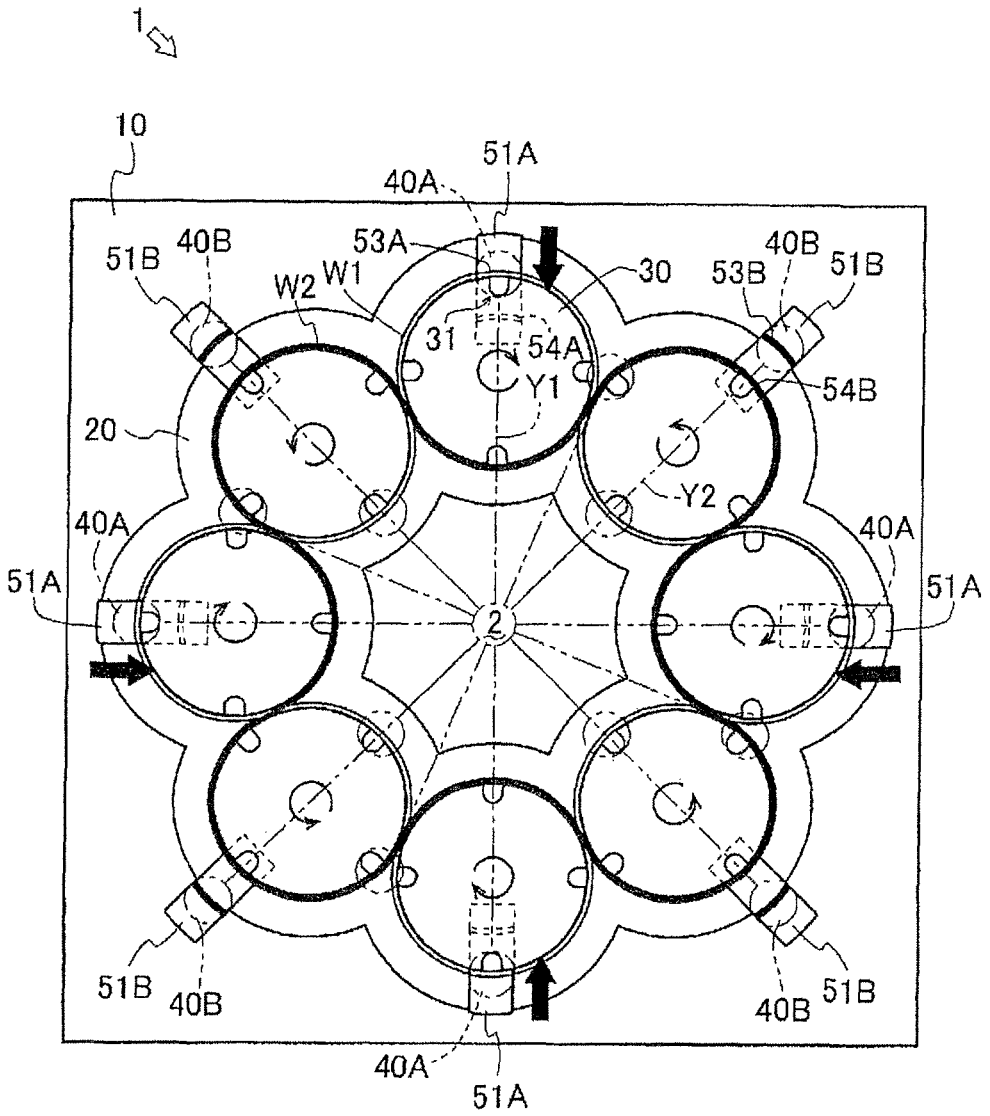
FIG. 15 is a drawing of the state that the four first bobbin carriers are conveyed onto the traveling track by the first movable member.
Figure 16:
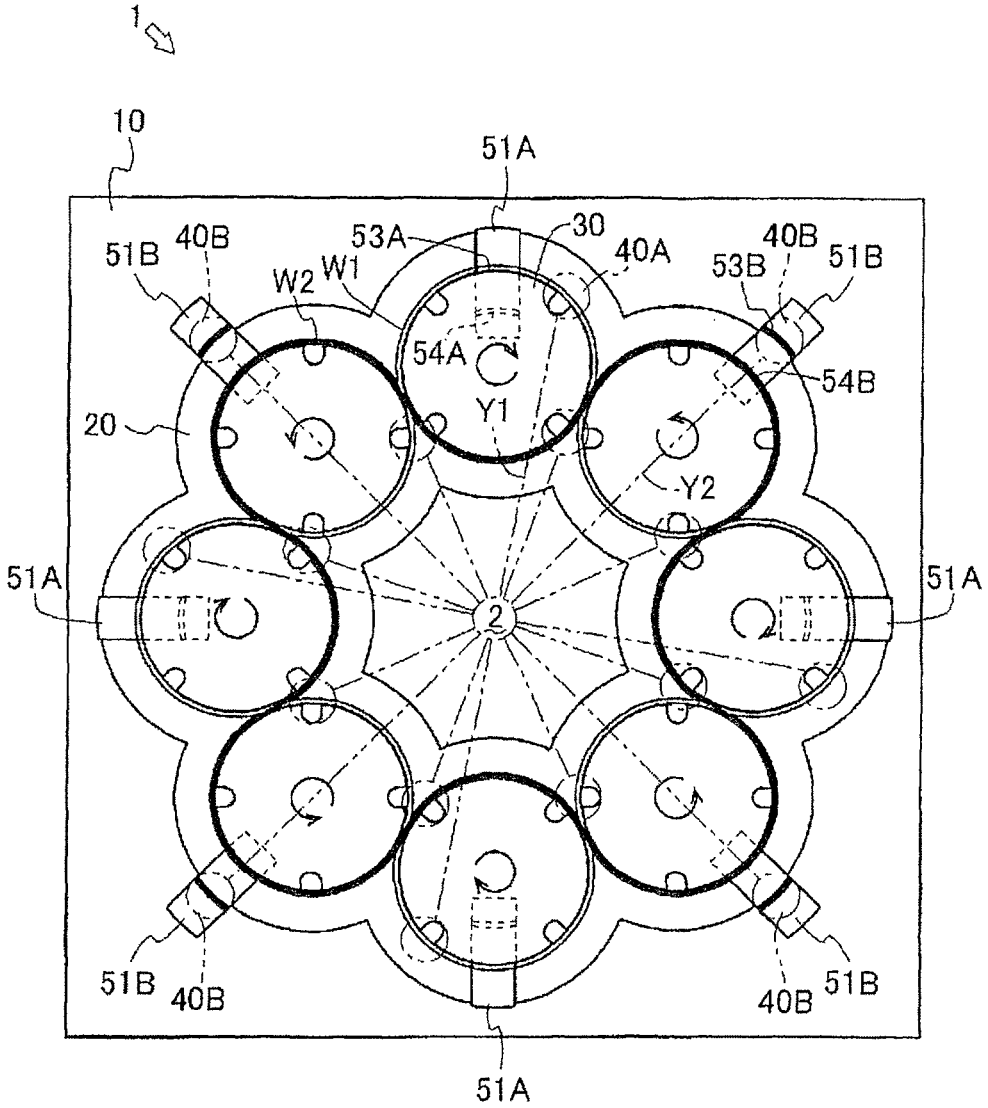
FIG. 16 is a drawing of the bobbin carrier at the time of winding the yarn.
Figure 17:
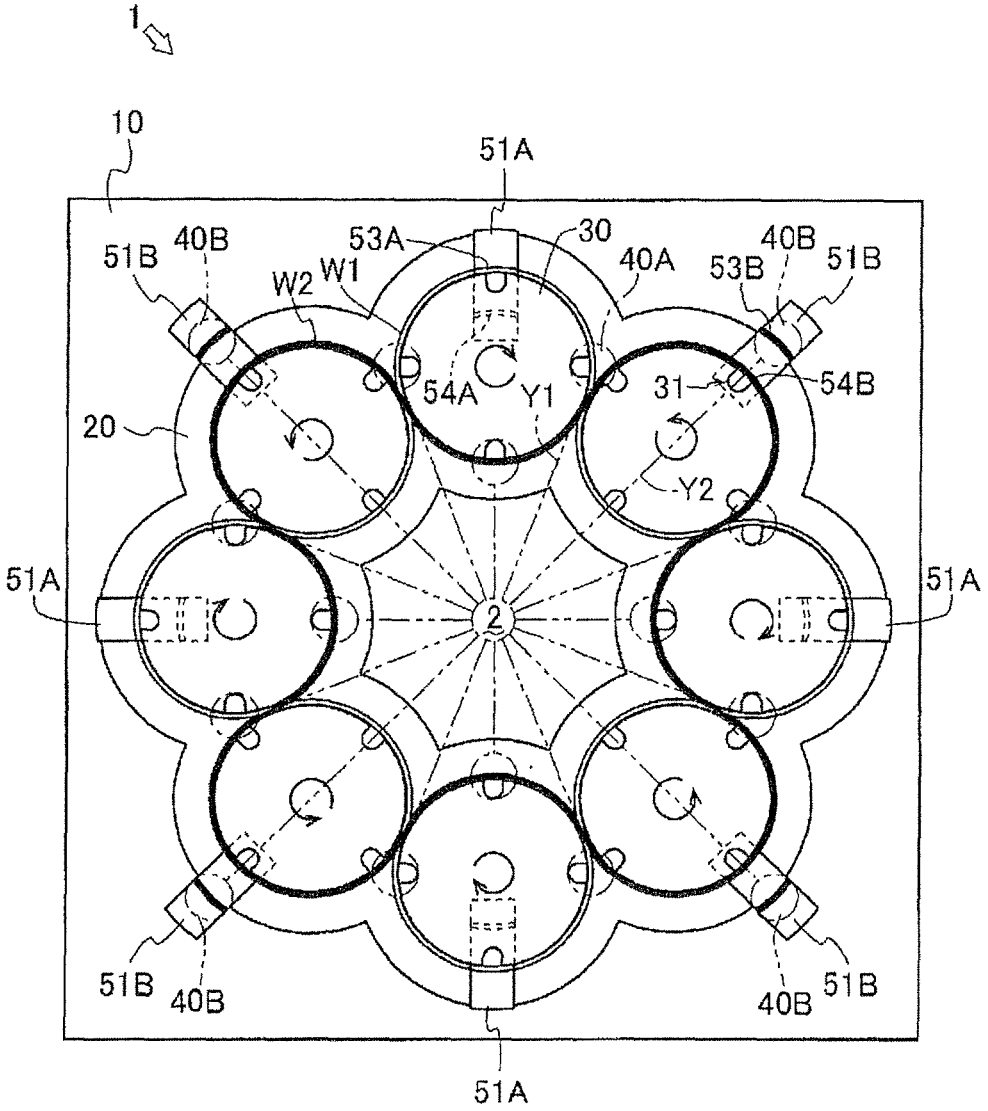
FIG. 17 is a drawing of the bobbin carrier at the time of winding the yarn.

(5) The bobbin carrier 40A (40B) is conveyed to the traveling track W1 (W2) with the bobbin carrier conveyance mechanism 50A (50B) (see FIGS. 15 and 18). As a result, the bobbin carrier 40A (40B) travels along the traveling track W1 (W2), and the braid Y1 (Y2) of the full bobbin is wound onto the mandrel 2.

In the braider 1, the bobbin carrier 40A (40B) is conveyed with the bobbin carrier conveyance mechanism 50A (50B) so that the bobbin carrier 40A (40B) is supplied to and separated from the traveling track W1 (W2). Namely, in the braider 1, when the bobbin carrier 40A (40B) is supplied to and separated from the traveling track W1 (W2), the bobbin carrier 40A (40B) is not made to travel. Accordingly, it is not necessary to provide any traveling track for supplying the bobbin carrier 40A (40B) to the traveling track W1 (W2) and separating the bobbin carrier 40A (40B) from the traveling track WI (W2). Therefore, the apparatus can be configured compactly. The bobbin 4 can be exchanged without providing any traveling track for supplying the bobbin carrier 40A (40B) to the traveling track W1 (W2) and separating the bobbin carrier 40A (40B) from the traveling track W1 (W2), whereby a mechanism for exchanging the bobbin 4 can be configured compactly.

In the braider 1, each of the bobbin carrier conveyance mechanisms 50A (50B) supplies the bobbin carrier 40A (40B) to the traveling track W1 (W2) and separates the bobbin carrier 40A (40B) from the traveling track W1 (W2) at the same position in the traveling track W1 (W2) (see FIGS. 7, 10, 15 and 18). Accordingly, in comparison with the case that a position at which the bobbin carrier 40A (40B) is supplied to the traveling track WI (W2) and a position at which the bobbin carrier 40A (40B) is separated from the traveling track W1 (W2) are provided separately, the apparatus can be configured compactly.

In the braider 1, while the impeller 30 is rotated in the braid winding direction, the movable member 51A (51B) can be moved between the first supply position (the second supply position) and the first separation position (the second separation position) with the actuator 52A (52B) so as to supply the bobbin carrier 40A (40B) to the traveling track W1 (W2) and separate the bobbin carrier 40A (40B) from the traveling track W1 (W2).

The braid winding direction is a rotation direction of the impeller 30 in the case in which the braids Y1 and Y2 are wound onto the outer peripheral surface of the mandrel 2 so as to manufacture the tube body 3.

Accordingly, the number of the braids Y1 and Y2 wound onto the mandrel 2 can be changed and the bobbin 4 can be exchanged without stopping the winding of the braids Y1 and Y2 onto the mandrel 2, whereby working efficiency can be improved.

An explanation will be given on bobbin carrier conveyance mechanisms 60A and 60B which is a second embodiment of the bobbin carrier conveyance mechanism.

Figure 21:
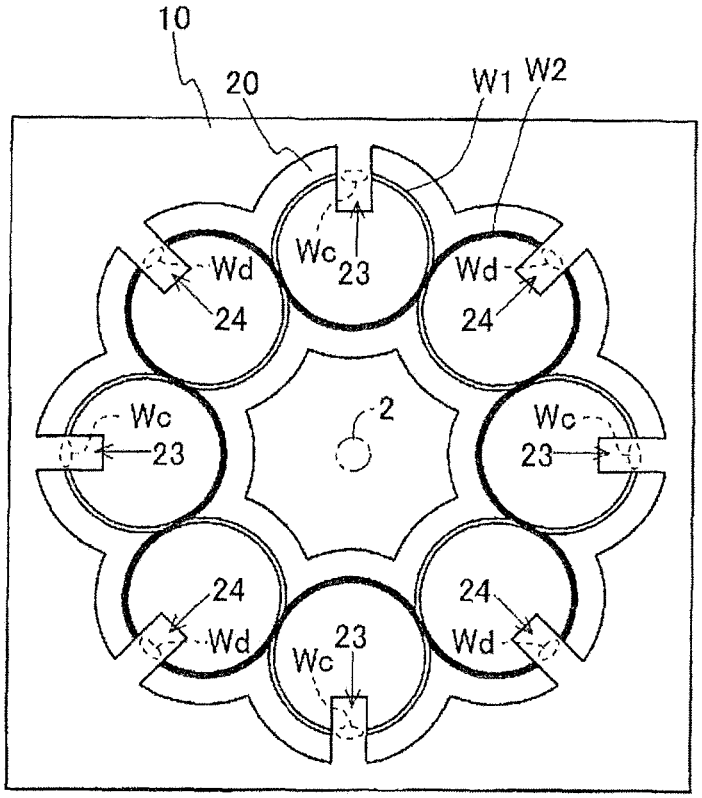
FIG. 21 is a drawing of a missing part of the traveling track.

As shown in FIG. 21, in the support member 20, a notched part 23 dividing the first traveling track WI and a notched part 24 dividing the second traveling track W2 are formed.

A missing part Wc is formed in the first traveling track W1 by the notched part 23, and a missing part Wd is formed in the second traveling track W2 by the notched part 24. The number of each of the missing parts Wc and Wd is at least one.

In this embodiment, the plurality of the notched parts 23 and 24 (the respective four notched parts 23 and 24) are formed, and consequently, the plurality of the missing parts Wc and Wd (the respective four missing parts Wc and Wd) are formed. The missing parts Wc and Wd are arranged mutually at intervals of 22.5° around the axis M.

Figure 22:
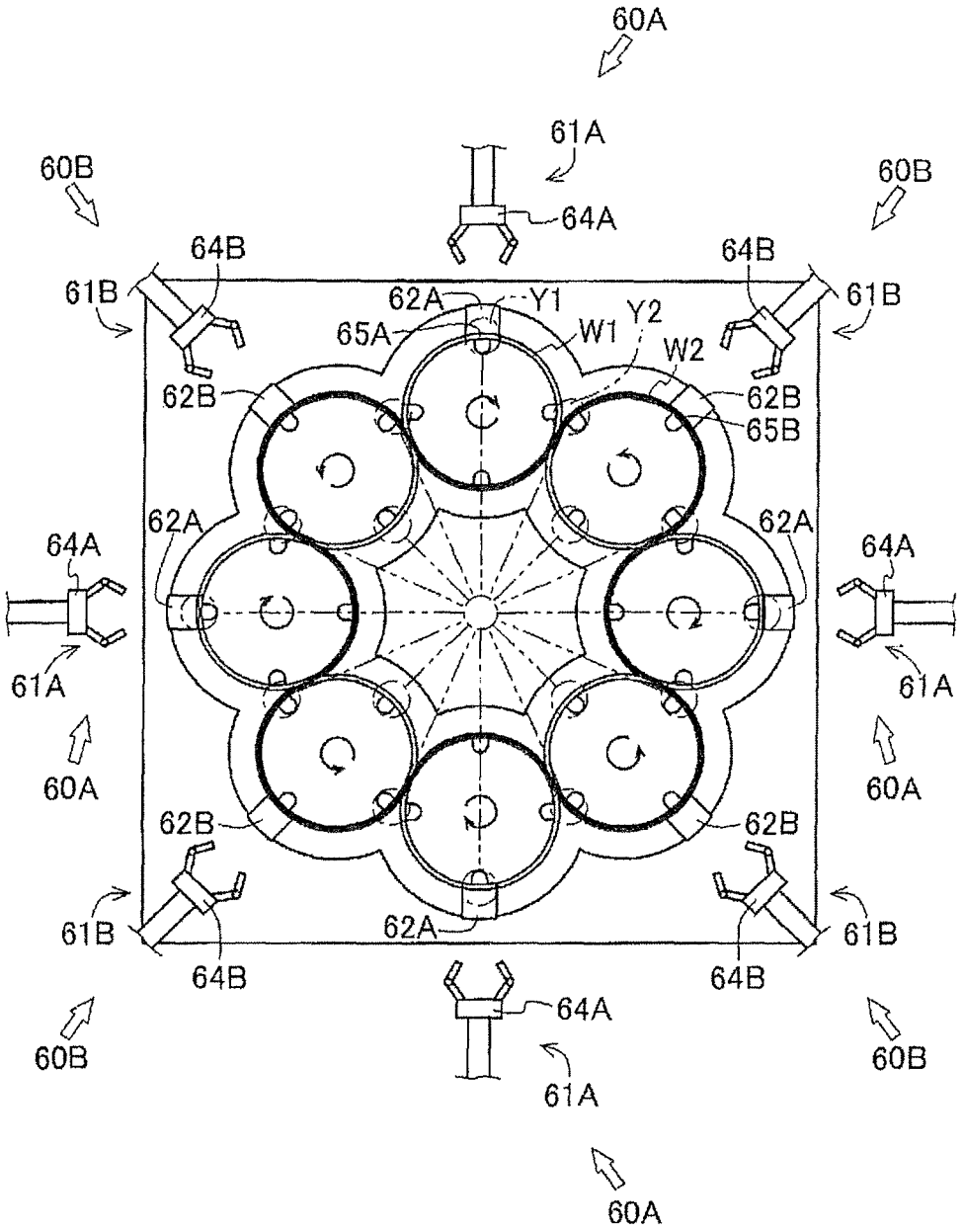
FIG. 22 is a drawing of a schematic configuration of a bobbin carrier conveyance mechanism of a second embodiment.

As shown in FIG. 22, the number of each of the bobbin carrier conveyance mechanisms 60A and 60B is at least one. The bobbin carrier conveyance mechanism 60A (60B) is provided for every notched part 23 (24) (see FIGS. 21 and 22). Therefore, in this embodiment, the number of each of the bobbin carrier conveyance mechanisms 60A and 60B is four.

The bobbin carrier conveyance mechanism 60A (60B) has a picking mechanism 61A (61B).

Figure 23:
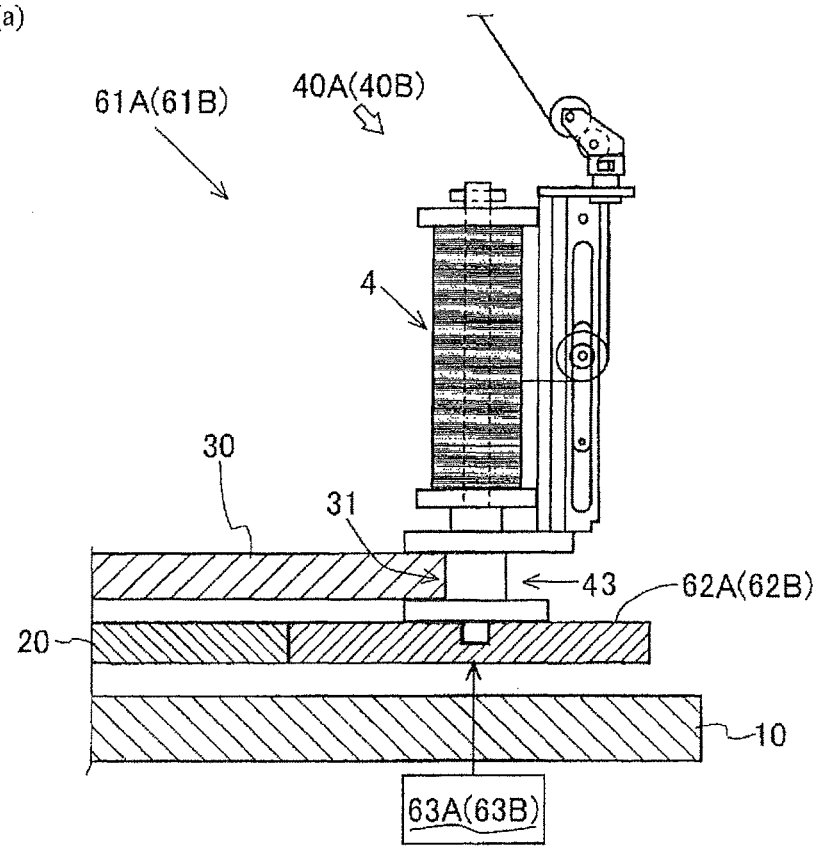
FIG. 23(*a*) is a partial sectional drawing of the state that the bobbin carrier reaches the movable member, and FIG. 23(*b*) is a drawing of a robot hand when the bobbin carrier is at the state of FIG. 23(*a*).
Figure 23:
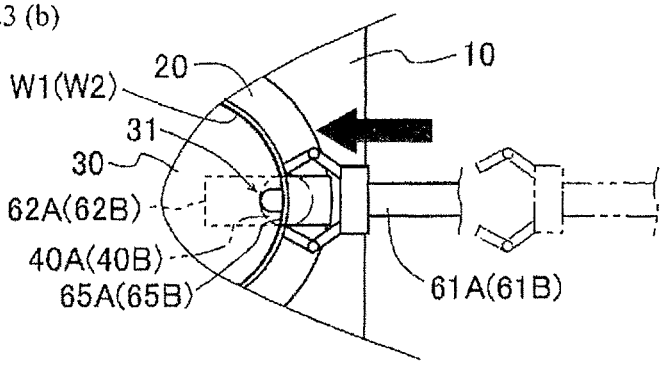

As shown in FIGS. 22 to 23(*b*), the picking mechanism 61A (61B) has a movable member 62A (62B), an actuator 63A (63B) and a robot hand 64A (64B) which is a conveyance means.

The movable member 62A (62B) has a plate-like shape which can be engaged with the notched part 23 (24).

In the first movable member 62A, a first complementary track part 65A is formed. The first movable member 62A is supported so as to be movable between a first engagement position and a first release position.

At the first engagement position, the first complementary track part 65A complements the missing part We of the first traveling track WI (see FIGS. 22 and 23(*a*)). At the first release position, the first movable member 62A is recessed with respect to the support member 20 (see FIGS. 21 and 24(*a*)). In this case, a recessing amount dl of the first movable member 62A is larger than a projection amount d2 of the slider part 44 of the first bobbin carrier 40A (d1>d2).

In the second movable member 62B, a second complementary track part 65B is formed.

The second movable member 62B is supported so as to be movable between a second engagement position and a second release position.

At the second engagement position, the second complementary track part 65B complements the missing part Wd of the second traveling track W2 (see FIGS. 22 and 23(*a*)).

Figure 24:
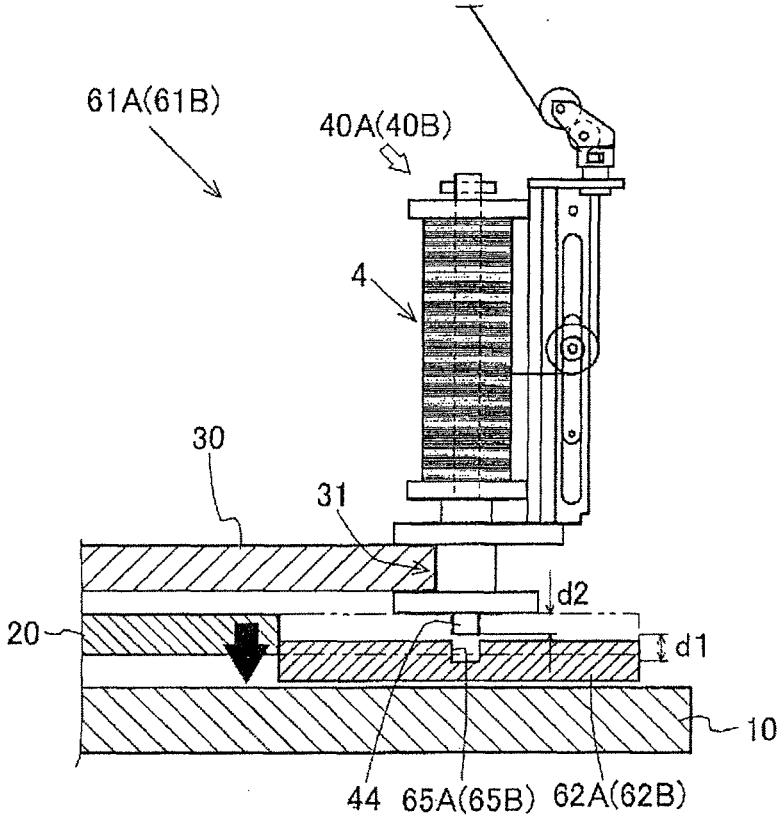
FIG. 24(*a*) is a partial sectional drawing of the state that engagement of the bobbin carrier with the traveling track is released, and FIG. 24(*b*) is a drawing of the robot hand when the bobbin carrier is at the state of FIG. 24(*a*).
Figure 24:
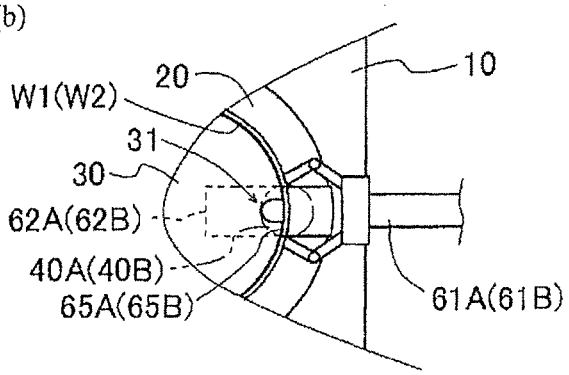

At the second release position, the second movable member 62B is recessed with respect to the support member 20 (see FIGS. 21 and 24(*a*)). In this case, a recessing amount d1 of the second movable member 62B is larger than a projection amount d2 of the slider part 44 of the second bobbin carrier 40B (d1>d2).

The actuator 63A (63B) is connected to the movable member 62A (62B) (see FIG. 23(*a*)). The movable member 62A (62B) can be moved between the first engagement position (the second engagement position) and the first release position (the second release position) with the actuator 63A (63B). For example, the actuator 63A (63B) includes a hydraulic cylinder or an air cylinder.

The robot hand 64A (64B) can grasp the bobbin carrier 40A (40B) and convey it.

An explanation will be given on operation of the picking mechanism 61A (61B).

Figure 25:
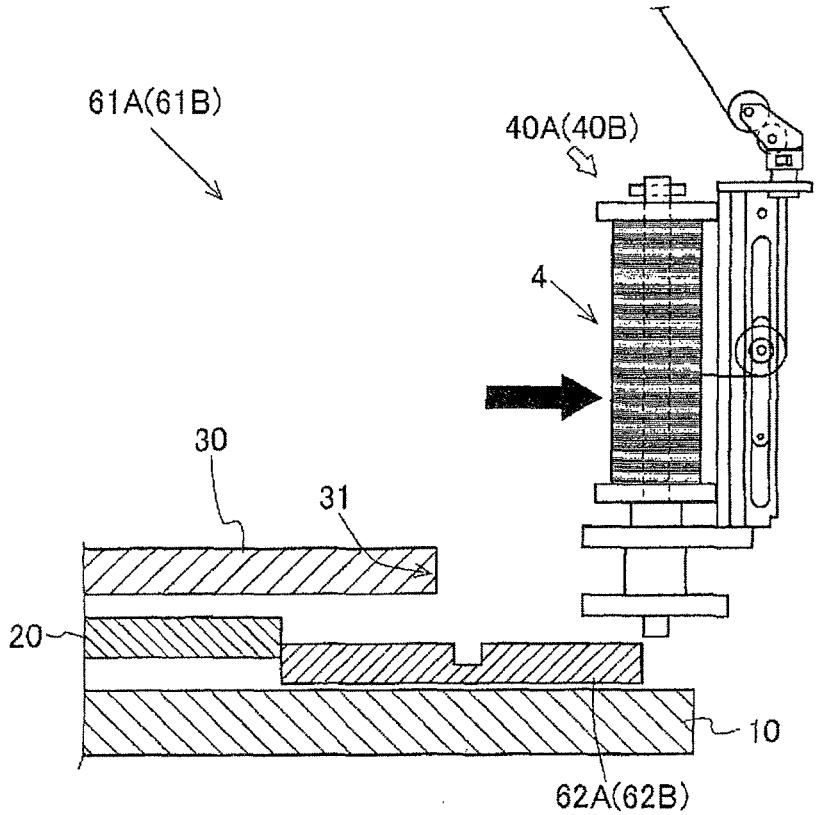
FIG. 25(*a*) is a partial sectional drawing of the state that the bobbin carrier is conveyed out of the traveling track, and FIG. 25(*b*) is a drawing of the robot hand when the bobbin carrier is at the state of FIG. 25(*a*).
Figure 25:
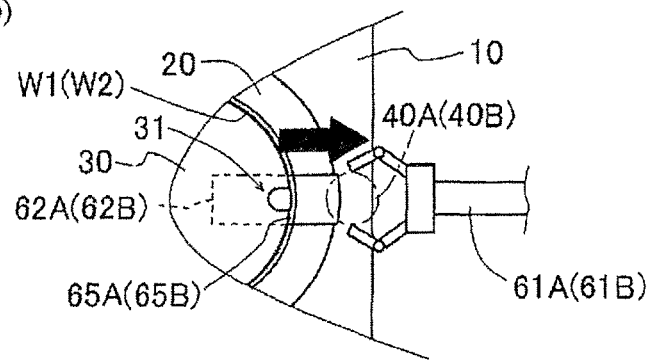

As shown in FIGS. 23(*a*) to 24(*b*), when the bobbin carrier 40A (40B) reaches the complementary track part 65A (65B), the bobbin carrier 40A (40B) is grasped with the robot hand 64A (64B) and the movable member 62A (62B) is moved from the first engagement position (the second engagement position) to the first release position (the second release position) with the actuator 63A (63B). Accordingly, the slider part 44 of the bobbin carrier 40A (40B) falls out from the complementary track part 65A (65B), and the engagement of the bobbin carrier 40A (40B) with the traveling track W1 (W2) is released. Then, as shown in FIGS. 25(*a*) and 25(*b*), the bobbin carrier 40A (40B) is conveyed out of the traveling track W1 (W2) with the robot hand 64A (64B) and stopped. As a result, the winding of the braid Y1 (Y2), which is spanned between the bobbin carrier 40A (40B) conveyed with the robot hand 64A (64B) and the mandrel 2, onto the mandrel 2 is stopped. At this time, the braid Y1 (Y2) whose winding onto the mandrel 2 is stopped is spanned between the bobbin carrier 40A (40B) and the mandrel 2 at a position at which the braid Y1 (Y2) cannot contact with the other braids Y1 and Y2.

After the bobbin carrier 40A (40B) is conveyed out of the traveling track WI (W2) with the robot hand 64A (64B), immediately, the movable member 62A (62B) is returned to the first engagement position (the second engagement position) with the actuator 63A (63B) (see the drawings) so as to prevent another bobbin carrier 40A (40B) traveling on the traveling track W1 (W2) from deviating.

Figure 26:
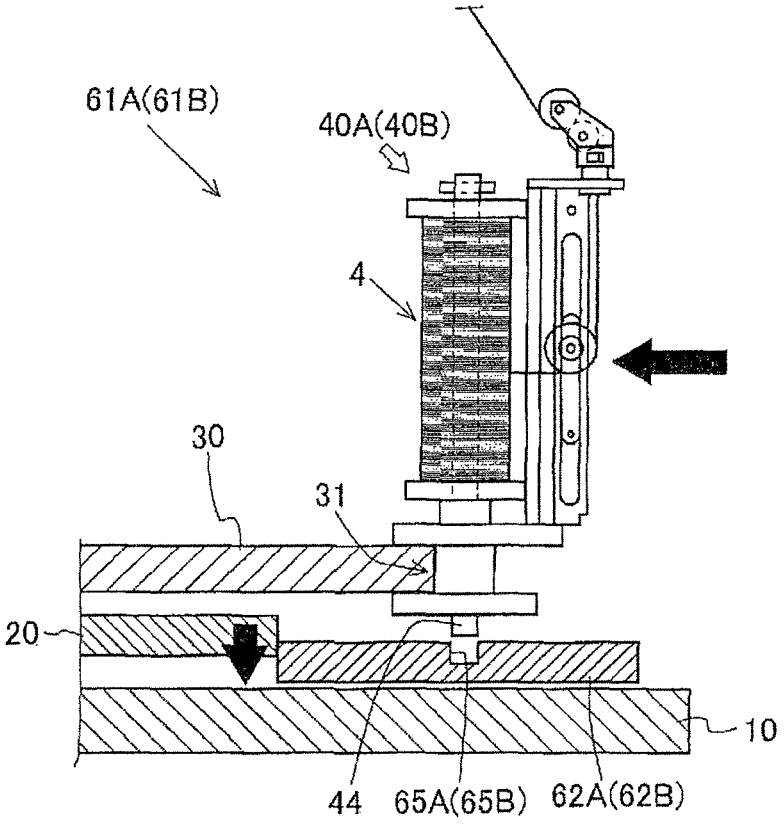
FIG. 26(*a*) is a partial sectional drawing of the state that the bobbin carrier is engaged with a notched part of an impeller, and FIG. 26(*b*) is a drawing of the robot hand when the bobbin carrier is at the state of FIG. 26(*a*).
Figure 26:
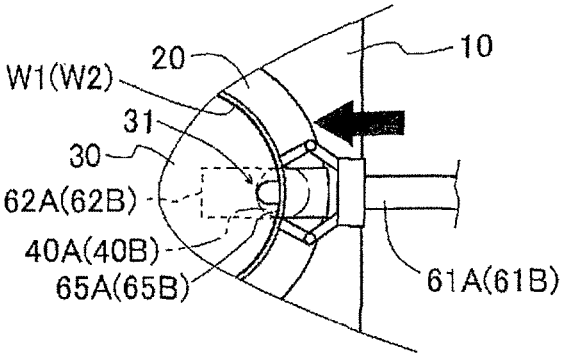
Figure 27:
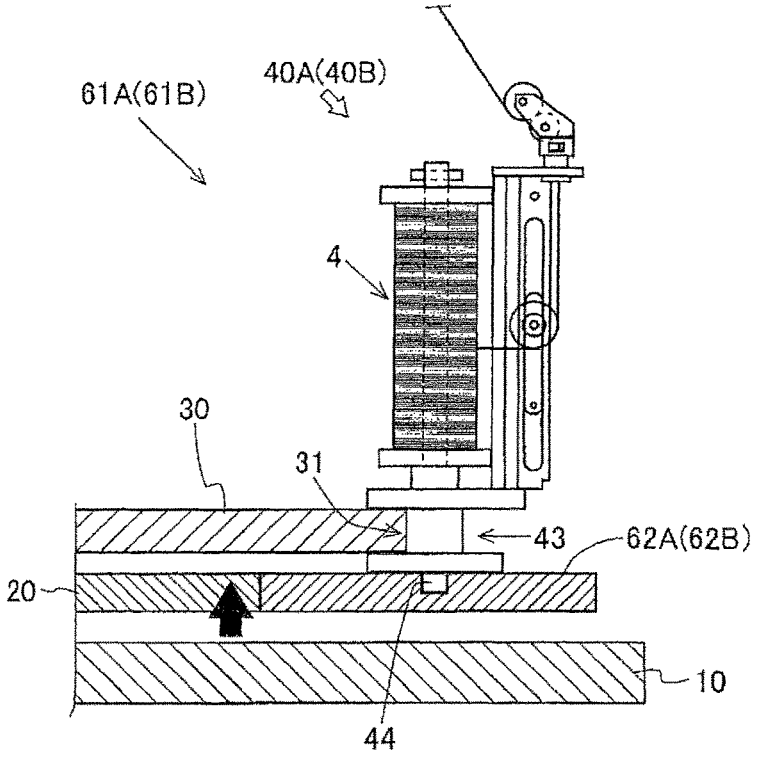
FIG. 27(*a*) is a partial sectional drawing of the state that the bobbin carrier is engaged with the traveling track, and FIG. 27(*b*) is a drawing of the robot hand when the bobbin carrier is at the state of FIG. 27(*a*).
Figure 27:
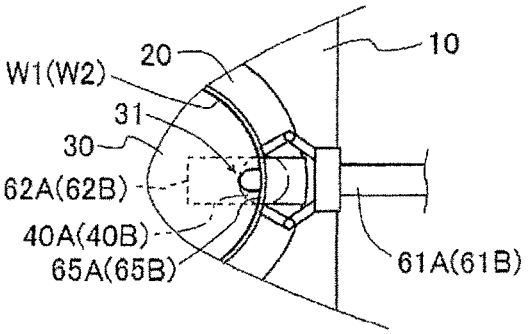

As shown in FIGS. 26(*a*) and 26(*b*), when the notched part 31 of the impeller 30 reaches the complementary track part 65A (65B) of the movable member 62A (62B), the movable member 62A (62B) is moved from the first engagement position (the second engagement position) to the first release position (the second release position) with the actuator 63A (63B). Then, the bobbin carrier 40A (40B) is conveyed to a position at which the bobbin carrier 40A (40B) is engaged with the notched part 31 of the impeller 30 with the robot hand 64A (64B). Then, as shown in FIGS. 27(*a*) and 27(*b*), the movable member 62A (62B) is returned from the first release position (the second release position) to the first engagement position (the second engagement position) with the actuator 63A (63B).

Accordingly, the slider part 44 of the bobbin carrier 40A (40B) is inserted into the complementary track part 65A (65B) and the bobbin carrier 40A (40B) is engaged with the traveling track W1 (W2). As a result, the bobbin carrier 40A (40B) starts to travel along the traveling track W1 (W2), and the winding of the braid Y1 (Y2), which is spanned between the bobbin carrier 40A (40B) and the mandrel 2, to the mandrel 2 is started.

The picking mechanisms 61A and 61B provide the same operation effect as the bobbin carrier conveyance mechanisms 50A and 50B of the first embodiment. Thus, an explanation of the operation effect of the picking mechanisms 61A and 61B is omitted.

An explanation will be given on picking mechanisms 71A and 71B which are variations of the picking mechanisms 61A and 61B.

When the picking mechanisms 71A and 71B are adopted, any notched part is not formed in the support member 20 and the traveling tracks W1 and W2 are not divided.

Figure 28:
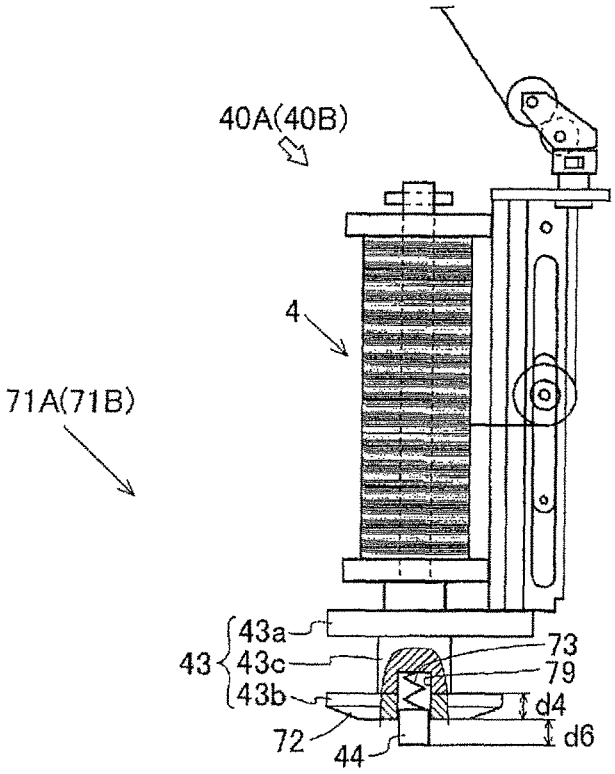
FIG. 28(*a*) is a drawing of a schematic configuration of a variation of a picking mechanism, and FIG. 28(*b*) is a sectional view of the variation of the picking mechanism.
Figure 28:
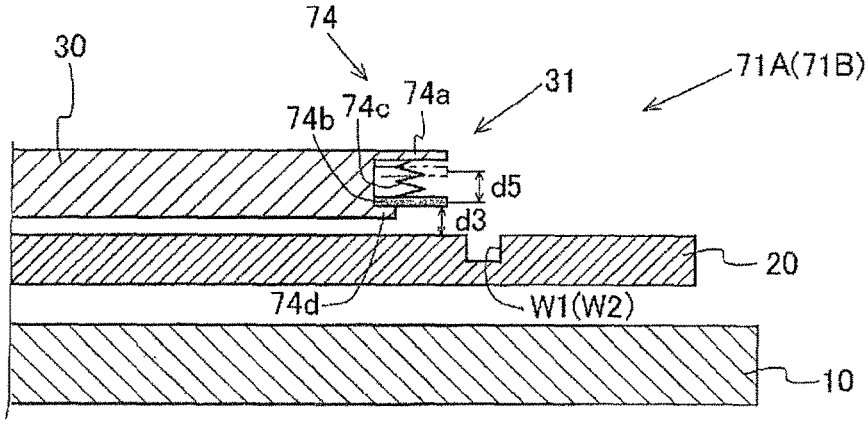

As shown in FIGS. 28(*a*) to 29(*c*), each of the picking mechanisms 71A and 71B has a tapered part 72, a biasing member 73, a biasing mechanism 74 and a robot hand 75A (75B) which is a conveyance means.

The tapered part 72 is formed in the second flange part 43*b* of the engagement part 43 of the bobbin carrier 40A (40B) and has a slope shape in which an outer peripheral surface of the second flange part 43*b* is tapered.

A hole 79 is formed in a tip surface of the engagement part 43, and the biasing member 73 is arranged in the hole 79.

A tip of the biasing member 73 is connected to the slider part 44 so as to bias the slider part 44 along a direction projecting from the hole 79.

The biasing mechanism 74 is formed in an edge of the notched part 31 of the impeller 30.

The biasing mechanism 74 has a first contact part 74*a* contacting the first flange part 43*a* of the bobbin carrier 40A (40B), a second contact part 74*b* contacting the second flange part 43*b*, and a biasing part 74*c* biasing the contact parts 74*a* and 74*b* so as to separate them from each other.

The first contact part 74*a* is fixed to the impeller 30 and configured integrally with the impeller 30. The second contact part 74*b* is separated from the impeller 30 and supported so as to be able to approach and leave from the first contact part 74*a*. In the impeller 30, a regulation part 74*d*, which regulates excessive leaving of the second contact part 74*b* from the first contact part 74*a*, is provided.

A distance d3 between the second contact part 74*b* and the support member 20 at the time at which the second contact part 74*b* contacts the regulation part 74*d* is substantially the same as a thickness d4 of the second flange part 43*b* (d3≈d4). The maximum movable distance d5 of the second contact part 74*b* is larger than the maximum projection amount d6 of the slider part 44 (d5>d6).

As shown in FIG. 29(*b*), the robot hand 75A (75B) has a pair of grasping parts 76A (76B). In each of the grasping parts 76A (76B), a tapered surface 77A (77B) is formed. The pair of the tapered surfaces 77A (77B) becomes close to each other toward their tips, and have shapes which can be engaged with the tapered part 72 of the second flange part 43*b* of the bobbin carrier 40A (40B). In each of the grasping parts 76A (76B), a pressing part 78A (78B) pressing the bobbin carrier 40A (40B) is formed.

An explanation will be given on operation of the picking mechanism 71A (71B).

As shown in FIGS. 29(*a*) to 31(*c*), when the bobbin carrier 40A (40B) travels along the traveling track W1 (W2), the bobbin carrier 40A (40B) is grasped and raised with the grasping parts 76A (76B) of the robot hand 75A (75B). Accordingly, the biasing part 74*c* is contracted and the slider part 44 of the bobbin carrier 40A (40B) falls out from the traveling track W1 (W2). Accordingly, the engagement of the bobbin carrier 40A (40B) with the traveling track W1 (W2) is released. Then, as shown in FIGS. 32(*a*) to 32(*c*), the bobbin carrier 40A (40B) is conveyed out of the traveling track W1 (W2) with the robot hand 75A (75B) and stopped. As a result, the winding of the braid Y1 (Y2), which is spanned between the bobbin carrier 40A (40B) conveyed with the robot hand 75A (75B) and the mandrel 2, onto the mandrel 2 is stopped. At this time, the braid Y1 (Y2) is spanned between the bobbin carrier 40A (40B) and the mandrel 2 at a position at which the braid Y1 (Y2) cannot contact with the other braids Y1 and Y2.

As shown in FIGS. 32(*a*) to 33(*c*), the slider part 44 of the bobbin carrier 40A (40B) is pressed to the support member 20 with the pressing parts 78A (78B) of the robot hand 75A (75B). Accordingly, the biasing member 73 is contracted and the slider part 44 sinks into the hole 79 of the engagement part 43. Then, as shown in FIGS. 33(*a*) to 34(*c*), while the slider part 44 sinks into the hole 79 of the engagement part 43, the bobbin carrier 40A (40B) is conveyed to a position at which the bobbin carrier 40A (40B) is engaged with the notched part 31 of the impeller 30 with the robot hand 75A (75B). When the bobbin carrier 40A (40B) is engaged with the notched part 31 of the impeller 30, the slider part 44 is projected from the hole 79 and enters the traveling track W1 (W2) by biasing force of the biasing member 73. Accordingly, the bobbin carrier 40A (40B) is engaged with the traveling track W1 (W2). As a result, the bobbin carrier 40A (40B) starts to travel along the traveling track W1 (W2), and the winding of the braid Y1 (Y2), which is spanned between the bobbin carrier 40A (40B) and the mandrel 2, to the mandrel 2 is started.

The picking mechanisms 71A and 71B provide the same operation effect as the bobbin carrier conveyance mechanisms 50A and 50B of the first embodiment. Thus, an explanation of the operation effect of the picking mechanisms 71A and 71B is omitted.

DESCRIPTION OF NOTATIONS

1 braider
2 mandrel
3 tube body
4 bobbin
20 support member
40A and 40B bobbin carriers
50A, 50B, 60A and 60B bobbin carrier conveyance mechanisms
61A, 61B, 71A and 71B picking mechanisms
W1 and W2 traveling tracks
Y1 and Y2 braids

The invention claimed is:

1. A braider wherein, while a mandrel is moved relatively to a support member in which a traveling track for a bobbin carrier is provided, the bobbin carrier travels along the traveling track so that strands spanned between the bobbin carrier and the mandrel are wound onto an outer peripheral surface of the mandrel, comprising:

a bobbin carrier conveyance mechanism in which the bobbin carrier is conveyed from the traveling track to an outside of the traveling track so as to stop winding of the strands onto the mandrel and the bobbin carrier is conveyed from the outside of the traveling track onto the traveling track so as to start the winding of the strands onto the mandrel, wherein a missing part is formed in the traveling track, and the bobbin carrier conveyance mechanism comprises:

a movable member in which an outer complementary track part and an inner complementary track part are formed and which can be moved between a supply position at which the outer complementary track part complements the missing part of the traveling track and the inner complementary track part is not included in the traveling track and a separation position at which the inner complementary track part complements the missing part of the traveling track and the outer complementary track part is not included in the traveling track, and an actuator which moves the movable member between the supply position and the separation position.

2. The braider according to claim 1, wherein the bobbin carrier conveyance mechanism supplies the bobbin carrier to the traveling track and separates the bobbin carrier from the traveling track at a same position in the traveling track.

3. The braider according to claim 2, further comprising:

an impeller which makes the bobbin carrier on the traveling track travel along the traveling track, wherein the bobbin carrier conveyance mechanism supplies the bobbin carrier to the traveling track and separates the bobbin carrier from the traveling track while the impeller is rotated along a braid winding direction.

4. The braider according to claim 1, wherein the bobbin carrier conveyance mechanism has a picking mechanism which can engage the bobbin carrier with the traveling track and release the engagement of the bobbin carrier with the traveling track.

5. The braider according to claim 2, wherein the bobbin carrier conveyance mechanism has a picking mechanism which can engage the bobbin carrier with the traveling track and release the engagement of the bobbin carrier with the traveling track.

6. The braider according to claim 3, wherein the bobbin carrier conveyance mechanism has a picking mechanism which can engage the bobbin carrier with the traveling track and release the engagement of the bobbin carrier with the traveling track.

* * * * *